US009388368B2

(12) United States Patent
Loughnane et al.

(10) Patent No.: US 9,388,368 B2
(45) Date of Patent: Jul. 12, 2016

(54) CLEANING COMPOSITIONS CONTAINING A POLYETHERAMINE

(71) Applicant: The Procter & Gamble Company, Cincinnati, OH (US)

(72) Inventors: Brian Joseph Loughnane, Fairfield, OH (US); Frank Hulskotter, Bad Duerkheim (DE); Stefano Scialla, Rome (IT); Sophia Rosa Ebert, Mannheim (DE); Bjoern Ludolph, Ludwigshafen (DE); Christof Wigbers, Mannheim (DE); Christian Eidamshaus, Mannheim (DE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 14/498,225

(22) Filed: Sep. 26, 2014

(65) Prior Publication Data

US 2016/0090564 A1 Mar. 31, 2016

(51) Int. Cl.

| | |
|---|---|
| ***C11D 1/00*** | (2006.01) |
| ***C11D 3/30*** | (2006.01) |
| ***C11D 3/386*** | (2006.01) |
| ***C11D 3/37*** | (2006.01) |
| ***C11D 11/00*** | (2006.01) |
| ***C11D 1/88*** | (2006.01) |
| ***C11D 1/94*** | (2006.01) |
| ***C11D 1/38*** | (2006.01) |
| ***C11D 1/02*** | (2006.01) |
| ***C11D 1/66*** | (2006.01) |

(52) U.S. Cl.

CPC ..... *C11D 3/3723* (2013.01); *C11D 1/02* (2013.01); *C11D 1/38* (2013.01); *C11D 1/66* (2013.01); *C11D 1/88* (2013.01); *C11D 1/94* (2013.01); *C11D 3/30* (2013.01); *C11D 3/386* (2013.01); *C11D 3/38609* (2013.01); *C11D 3/38618* (2013.01); *C11D 3/38627* (2013.01); *C11D 11/0017* (2013.01)

(58) Field of Classification Search

CPC ..... C11D 1/02; C11D 1/38; C11D 1/66; C11D 1/88; C11D 1/94; C11D 3/30; C11D 3/386; C11D 3/38609; C11D 3/38618; C11D 3/38627; C11D 11/0017

USPC ..... 510/320, 321, 392, 393, 350, 351, 356, 510/357, 499; 8/137

See application file for complete search history.

(56) References Cited

U.S. PATENT DOCUMENTS

| | | | | |
|---|---|---|---|---|
| 3,654,370 | A | 4/1972 | Yeakey et al. | |
| 4,450,091 | A | 5/1984 | Schmolka | |
| 4,537,705 | A | 8/1985 | Mahoney et al. | |
| 4,556,509 | A | 12/1985 | Demangeon et al. | |
| 4,609,683 | A | 9/1986 | Grigsby, Jr. et al. | |
| 4,764,291 | A | 8/1988 | Steltenkamp | |
| 4,820,436 | A | 4/1989 | Andree et al. | |
| 5,317,076 | A | 5/1994 | Primeaux, II | |
| 5,571,286 | A | 11/1996 | Connell et al. | |
| 5,863,886 | A | 1/1999 | Tracy et al. | |
| 2,295,623 | A | 9/1999 | Baillely et al. | |
| 6,146,427 | A | 11/2000 | Crutcher | |
| 6,172,021 | B1 | 1/2001 | Ofosu-Asante et al. | |
| 6,172,024 | B1 | 1/2001 | Arvanitidou | |
| 6,191,099 | B1 | 2/2001 | Crutcher | |
| 6,347,055 | B1 | 2/2002 | Motomura | |
| 6,365,561 | B1 * | 4/2002 | Vinson | C11D 3/0094 510/235 |
| 6,369,024 | B1 | 4/2002 | Panandiker et al. | |
| 6,437,055 | B1 | 8/2002 | Moriarity et al. | |
| 6,462,008 | B1 | 10/2002 | Ortiz et al. | |
| 1,009,800 | A1 | 1/2003 | Ortiz et al. | |
| 1,073,703 | A1 | 7/2003 | Vinson et al. | |
| 6,589,926 | B1 * | 7/2003 | Vinson | C11D 1/652 510/237 |
| 6,652,667 | B2 | 11/2003 | Ahmadi et al. | |
| 6,703,523 | B1 | 3/2004 | Boeckh et al. | |
| 6,710,023 | B1 | 3/2004 | Bodet et al. | |
| 6,857,485 | B2 | 2/2005 | Patel et al. | |
| 6,951,710 | B2 | 10/2005 | Rieker et al. | |
| 7,037,883 | B2 | 5/2006 | Hsu et al. | |
| 7,387,992 | B2 | 6/2008 | Hsu et al. | |
| 7,816,481 | B2 | 10/2010 | Klein et al. | |
| 8,097,577 | B2 * | 1/2012 | Danziger | C08G 73/02 510/356 |
| 8,193,144 | B2 | 6/2012 | Tanner et al. | |
| 8,247,368 | B2 * | 8/2012 | Danziger | C11D 3/3723 510/360 |
| 8,471,065 | B2 * | 6/2013 | Burton | C07C 217/08 564/478 |
| 8,586,039 | B2 | 11/2013 | Tsuchiya et al. | |
| 8,815,007 | B2 * | 8/2014 | Tanner | C08G 65/22 106/401 |
| 2002/0147368 | A1 | 10/2002 | Wei et al. | |

(Continued)

FOREIGN PATENT DOCUMENTS

| | | | |
|---|---|---|---|
| DE | 1643426 | A1 | 3/1979 |
| DE | 19854592 | A1 | 5/2000 |

(Continued)

OTHER PUBLICATIONS

U.S. Appl. No. 14/486,478, Sep. 15, 2014, Brian Joseph Loughnane, et al.

U.S. Appl. No. 14/496,577, Sep. 15, 2014, Brian Joseph Loughnane, et al.

U.S. Appl. No. 14/496,131, Sep. 25, 2014, Frank Hulskotter.

U.S. Appl. No. 14/496,151, Sep. 25, 2014, Brian Joseph Loughnane, et al.

International Search Report for PCT/US2014/031939, dated Jul. 7, 2014, containing 14 pages.

(Continued)

*Primary Examiner* — Gregory R Delcotto

(74) *Attorney, Agent, or Firm* — Gregory S. Darley-Emerson; Leonard W. Lewis; Steve W. Miller

(57) ABSTRACT

The present invention relates generally to cleaning compositions and, more specifically, to cleaning compositions containing a polyetheramine that is suitable for removal of stains from soiled materials.

15 Claims, No Drawings

(56) References Cited

U.S. PATENT DOCUMENTS

| | | | | |
|---|---|---|---|---|
| 2005/0027141 | A1* | 2/2005 | Furushima | C07C 213/02 564/474 |
| 2006/0074004 | A1* | 4/2006 | Johnson | C11D 1/65 510/499 |
| 2010/0323943 | A1* | 12/2010 | Evers | C11D 3/364 510/236 |
| 2011/0009670 | A1* | 1/2011 | Renken | C07C 209/16 564/447 |
| 2012/0259075 | A1* | 10/2012 | Klein | C07C 213/02 525/523 |
| 2012/0309884 | A1 | 12/2012 | Walker et al. | |
| 2013/0291315 | A1 | 11/2013 | Bennett et al. | |
| 2014/0255330 | A1 | 9/2014 | Cron et al. | |
| 2014/0296124 | A1* | 10/2014 | Hulskotter | C11D 3/0036 510/300 |
| 2014/0296127 | A1 | 10/2014 | Hulskotter et al. | |
| 2015/0057212 | A1 | 2/2015 | Hulskotter et al. | |
| 2015/0275142 | A1 | 10/2015 | Hulskotter et al. | |
| 2015/0275144 | A1 | 10/2015 | Hulskotter et al. | |

FOREIGN PATENT DOCUMENTS

| | | | |
|---|---|---|---|
| EP | 1664254 | B9 | 8/2004 |
| EP | 1436374 | B1 | 8/2008 |
| GB | 581 994 | A | 10/1946 |
| JP | 2011/0001504 | | 1/2011 |
| WO | WO 86/07603 | | 12/1986 |
| WO | WO 90/03423 | | 4/1990 |
| WO | WO 97/30103 | | 8/1997 |
| WO | WO 98/28393 | | 7/1998 |
| WO | WO 00/63334 | | 10/2000 |
| WO | WO 01/27232 | A1 | 4/2001 |
| WO | WO 01/76729 | A2 | 10/2001 |
| WO | WO 2009/065738 | A3 | 9/2009 |
| WO | WO 2012/126665 | A1 | 9/2012 |

OTHER PUBLICATIONS

International Search Report for PCT/US2014/031941, dated Jul. 3, 2014, containing 14 pages.

International Search Report for PCT/US2014/051165, dated Dec. 1, 2014, containing 10 pages.

International Search Report for PCT/US2015/021968, dated Jul. 9, 2015, containing 11 pages.

www.huntsman.com/portal/page/.../jeffamine_polyetheramines, downloaded on Jun. 9, 2015.

International Search Report for PCT/US2015/021970, dated Jul. 8, 2015, containing 13 pages.

International Search Report for PCT/US2015/022927, dated Sep. 11, 2015, containing 12 pages.

International Search Report for PCT/US2015/052082, dated Dec. 17, 2015, containing 13 pages.

* cited by examiner

CLEANING COMPOSITIONS CONTAINING A POLYETHERAMINE

TECHNICAL FIELD

The present invention relates generally to cleaning compositions and, more specifically, to cleaning compositions containing a polyetheramine that is suitable for removal of stains from soiled materials.

BACKGROUND

Due to the increasing popularity of easy-care fabrics made of synthetic fibers as well as the ever increasing energy costs and growing ecological concerns of detergent users, the once popular warm and hot water washes have now taken a back seat to washing fabrics in cold water (30° C. and below). Many commercially available laundry detergents are even advertised as being suitable for washing fabrics at 15° C. or even 9° C. To achieve satisfactory washing results at such low temperatures, results comparable to those obtained with hot water washes, the demands on low-temperature detergents are especially high.

It is known to include certain additives in detergent compositions to enhance the detergent power of conventional surfactants so as to improve the removal of grease stains at temperatures of 30° C. and below. For example, laundry detergents containing an aliphatic amine compound, in addition to at least one synthetic anionic and/or nonionic surfactant, are known. Also, the use of linear, alkyl-modified (secondary) alkoxypropylamines in laundry detergents to improve cleaning at low temperatures is known. These known laundry detergents, however, are unable to achieve satisfactory cleaning at cold temperatures.

Furthermore, the use of linear, primary polyoxyalkyleneamines (e.g., Jeffamine® D-230) to stabilize fragrances in laundry detergents and provide longer lasting scent is also known. Also, the use of high-molecular-weight (molecular weight of at least about 1000), branched, trifunctional, primary amines (e.g., Jeffamine® T-5000 polyetheramine) to suppress suds in liquid detergents is known. Additionally, an etheramine mixture containing a monoether diamine (e.g., at least 10% by weight of the etheramine mixture), methods for its production, and its use as a curing agent or as a raw material in the synthesis of polymers are known. Finally, the use of compounds derived from the reaction of diamines or polyamines with alkylene oxides and compounds derived from the reaction of amine terminated polyethers with epoxide functional compounds to suppress suds is known.

There is a continuing need for a detergent additive that can improve cleaning performance at low wash temperatures, e.g., at 30° C. or even lower, without interfering with the production and the quality of the laundry detergents in any way. More specifically, there is a need for a detergent additive that can improve cold water grease cleaning, without adversely affecting particulate cleaning. Surprisingly, it has been found that the cleaning compositions of the invention provide increased grease removal (particularly in cold water).

SUMMARY

The present invention attempts to solve one more of the needs by providing a cleaning composition comprising: from about 1% to about 70%, by weight of the composition, of a surfactant; and from about 0.1% to about 10%, by weight of the composition, of a polyetheramine of Formula (I):

Formula (1)

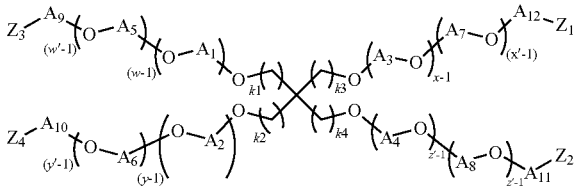

where each of $k_1$, $k_2$, $k_3$, and $k_4$ is independently selected from 0, 1, 2, 3, 4, 5, or 6, each of $A_1$, $A_2$, $A_3$, $A_4$, $A_5$, $A_6$, $A_7$, $A_8$, $A_9$, $A_{10}$, $A_{11}$, and $A_{12}$ is independently selected from a linear or branched alkylene group having from about 2 to about 18 carbon atoms or mixtures thereof, $x \geq 1$, $y \geq 1$, $w \geq 1$, and $z \geq 1$, and the sum of $x+y+w+z$ is in the range of from about 4 to about 100, $x' \geq 1$, $y' \geq 1$, $w' \geq 1$, and $z' \geq 1$, and the sum of $x'+y'+w'+z'$ is in the range of from about 4 to about 100, and each of $Z_1$, $Z_2$, $Z_3$, and $Z_4$ is independently selected from OH, $NH_2$, NHR', or NR'R", where R' and R" are independently selected from alkylenes having 2 to 6 carbon atoms.

The present invention further relates to a cleaning composition comprising: from about 1% to about 70%, by weight of the composition, of a surfactant; and from about 0.1% to about 10%, by weight of the composition, of a polyetheramine selected from the group consisting of Formula A, Formula B, Formula C, Formula D, Formula E, and mixtures thereof:

Formula A

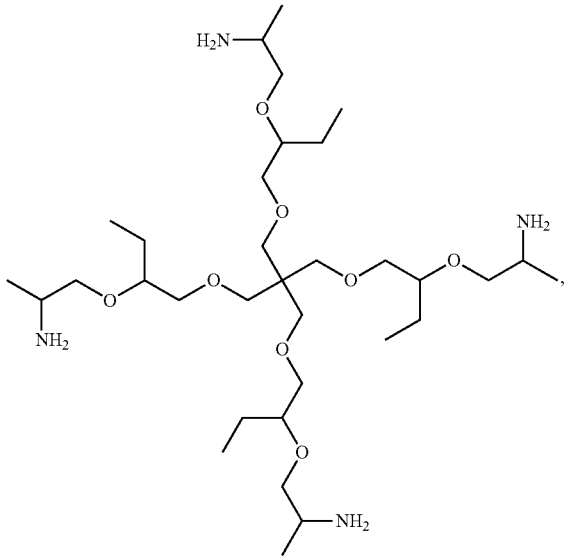

Formula B

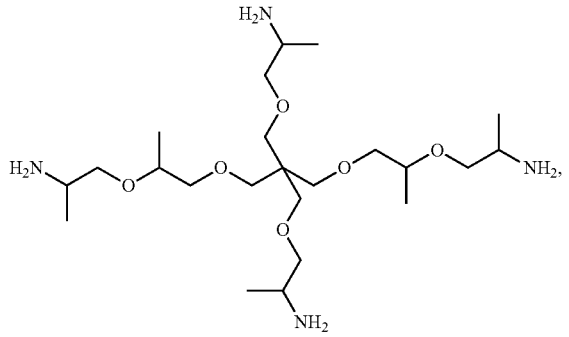

-continued

Formula C

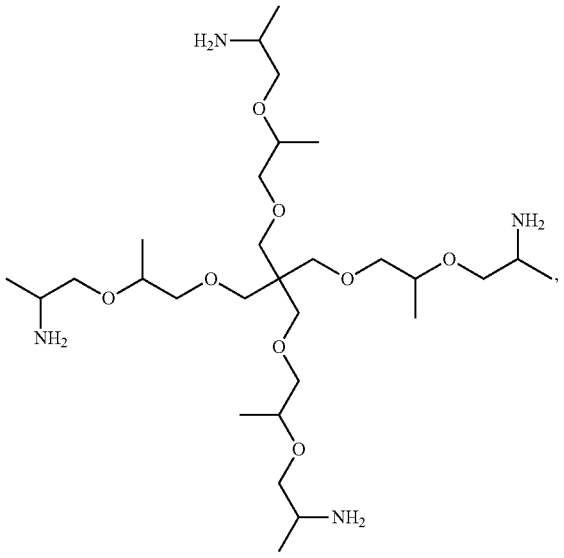

Formula D

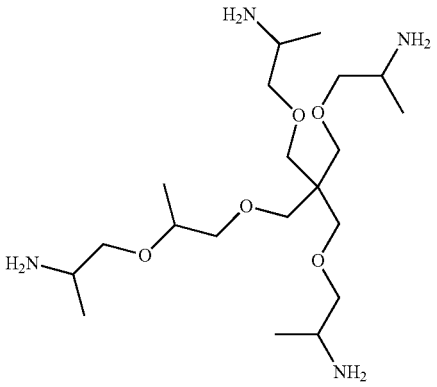

Formula E

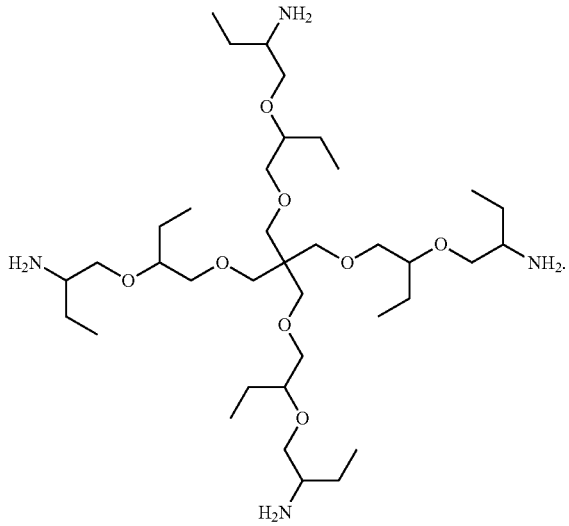

The present invention further relates to a method of pretreating or treating a soiled fabric comprising contacting the soiled fabric with the cleaning compositions of the invention.

DETAILED DESCRIPTION

Features and benefits of the various embodiments of the present invention will become apparent from the following description, which includes examples of specific embodiments intended to give a broad representation of the invention. Various modifications will be apparent to those skilled in the art from this description and from practice of the invention. The scope is not intended to be limited to the particular forms disclosed and the invention covers all modifications, equivalents, and alternatives falling within the spirit and scope of the invention as defined by the claims.

As used herein, the articles including "the," "a" and "an" when used in a claim or in the specification, are understood to mean one or more of what is claimed or described.

As used herein, the terms "include," "includes" and "including" are meant to be non-limiting.

The term "substantially free of" or "substantially free from" as used herein refers to either the complete absence of an ingredient or a minimal amount thereof merely as impurity or unintended byproduct of another ingredient. A composition that is "substantially free" of/from a component means that the composition comprises less than about 0.5%, 0.25%, 0.1%, 0.05%, or 0.01%, or even 0%, by weight of the composition, of the component.

As used herein, the term "soiled material" is used non-specifically and may refer to any type of flexible material consisting of a network of natural or artificial fibers, including natural, artificial, and synthetic fibers, such as, but not limited to, cotton, linen, wool, polyester, nylon, silk, acrylic, and the like, as well as various blends and combinations. Soiled material may further refer to any type of hard surface, including natural, artificial, or synthetic surfaces, such as, but not limited to, tile, granite, grout, glass, composite, vinyl, hardwood, metal, cooking surfaces, plastic, and the like, as well as blends and combinations.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

All cited patents and other documents are, in relevant part, incorporated by reference as if fully restated herein. The citation of any patent or other document is not an admission that the cited patent or other document is prior art with respect to the present invention.

In this description, all concentrations and ratios are on a weight basis of the cleaning composition unless otherwise specified.

Cleaning Composition

As used herein the phrase "cleaning composition" or "detergent composition" includes includes compositions and formulations designed for cleaning soiled material. Such compositions include but are not limited to, laundry cleaning compositions and detergents, fabric softening compositions, fabric enhancing compositions, fabric freshening compositions, laundry prewash, laundry pretreat, laundry additives, spray products, dry cleaning agent or composition, laundry rinse additive, wash additive, post-rinse fabric treatment, ironing aid, dish washing compositions, hard surface cleaning compositions, unit dose formulation, delayed delivery formulation, detergent contained on or in a porous substrate or nonwoven sheet, and other suitable forms that may be apparent to one skilled in the art in view of the teachings herein. Such compositions may be used as a pre-laundering treatment, a post-laundering treatment, or may be added during the rinse or wash cycle of the laundering operation. The cleaning compositions may have a form selected from liquid, powder, single-phase or multi-phase unit dose, pouch, tablet, gel, paste, bar, or flake.

Polyetheramines

The cleaning compositions described herein may include from about 0.1% to about 10%, or from about 0.2% to about 5%, or from about 0.5% to about 3%, by weight the composition, of a polyetheramine.

The polyetheramine may be represented by the structure of Formula (I),

Formula (I)

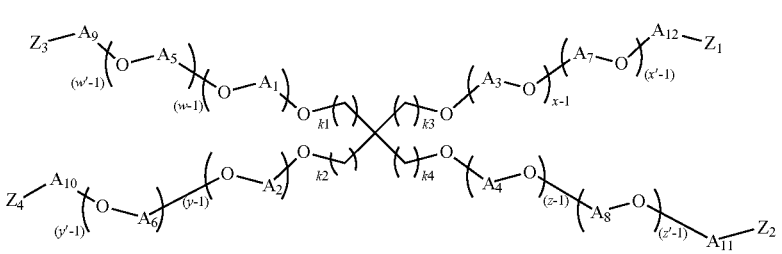

wherein each of $k_1$, $k_2$, $k_3$, and $k_4$ is independently selected from 0, 1, 2, 3, 4, 5, or 6, each of $A_1$, $A_2$, $A_3$, $A_4$, $A_{59}$ $A_6$, $A_7$, $A_8$, $A_9$, $A_{109}$ $A_{11}$, and $A_{12}$ is independently selected from a linear or branched alkylene group having from about 2 to about 18 carbon atoms or mixtures thereof, x≥1, y≥1, w≥1, and z≥1, the sum of x+y+w+z is in the range of from about 4 to about 100, x'≥1, y'≥1, w'≥1, and z'≥1, the sum of x'+y'+w'+z' is in the range of from about 4 to about 100, and each of $Z_1$, $Z_2$, $Z_3$, and $Z_4$ is independently selected from OH, $NH_2$, NHR', or NR'R", where R' and R" are independently selected from alkylenes having 2 to 6 carbon atoms.

At least one, or at least two, or at least three of $Z_1$, $Z_2$, $Z_3$, and $Z_4$ may be $NH_2$.

Each and every one of $Z_1$, $Z_2$, $Z_3$, and $Z_4$ may be $NH_2$.

Each and every one of $Z_1$, $Z_2$, $Z_3$, and $Z_4$ may be OH.

Each of $k_1$, $k_2$, $k_3$, and $k_4$ may be independently selected from 0, 1, or 2. Each of $k_1$, $k_2$, $k_3$, and $k_4$ may be independently selected from 0 or 1. At least two of $k_1$, $k_2$, $k_3$, and $k_4$ may be 1. Each of $k_1$, $k_2$, $k_3$, and $k_4$ may be 1.

$A_1$, $A_2$, $A_3$, $A_4$, $A_5$, $A_6$, $A_7$, $A_8$, $A_9$, $A_{10}$, $A_{11}$, and $A_{12}$ may be the same or different. At least two of $A_1$-$A_{12}$ may be the same, at least two of $A_1$-$A_{12}$ may be different, or each of $A_1$-$A_{12}$ may be different from each other. Each of $A_1$, $A_2$, $A_3$, $A_4$, $A_5$, $A_6$, $A_7$, $A_8$, $A_9$, $A_{10}$, $A_{11}$, and $A_{12}$ may be independently selected from a linear or branched alkylene group having from about 2 to about 10 carbon atoms, or from about 2 to about 6 carbon atoms, or from about 2 to about 4 carbon atoms. At least one, or at least three, of $A_1$-$A_{12}$ may be a linear or branched butylene group. Each of $A_5$, $A_6$, $A_7$, and $A_8$ may be a linear or branched butylene group. Each of $A_1$-$A_{12}$ may be a linear or branched butylene group.

x, x', y, y', w, w', z, and/or z' may each be independently equal to 3 or greater, meaning that the polyetheramine of Formula (I) may have more than one [$A_1$-O] group, more than one [$A_2$-O] group, more than one [$A_3$-O] group, more than one [$A_4$-O] group, more than one [$A_5$-O] group, more than one [$A_6$-O] group, more than one [$A_7$-O] group, and/or more than one [$A_8$-O] group. $A_1$ may be selected from ethylene, propylene, butylene, or mixtures thereof. $A_2$ may be selected from ethylene, propylene, butylene, or mixtures thereof. $A_3$ may be selected from ethylene, propylene, butylene, or mixtures thereof. $A_4$ may be selected from ethylene, propylene, butylene, or mixtures thereof. $A_5$ may be selected from ethylene, propylene, butylene, or mixtures thereof. $A_6$ may be selected from ethylene, propylene, butylene, or mixtures thereof. $A_7$ may be selected from ethylene, propylene, butylene, or mixtures thereof. $A_8$ may be selected from ethylene, propylene, butylene, or mixtures thereof.

[$A_1$-O] may be selected from ethylene oxide, propylene oxide, butylene oxide, or mixtures thereof. [$A_2$-O] may be selected from ethylene oxide, propylene oxide, butylene oxide, or mixtures thereof. [$A_3$-O] may be selected from ethylene oxide, propylene oxide, butylene oxide, or mixtures thereof. [$A_4$-O] may be selected from ethylene oxide, propylene oxide, butylene oxide, or mixtures thereof. [$A_5$-O] may be selected from ethylene oxide, propylene oxide, butylene oxide, or mixtures thereof. [$A_6$-O] may be selected from ethylene oxide, propylene oxide, butylene oxide, or mixtures thereof. [$A_7$-O] may be selected from ethylene oxide, propylene oxide, butylene oxide, or mixtures thereof. [$A_8$-O] may be selected from ethylene oxide, propylene oxide, butylene oxide, or mixtures thereof.

When $A_1$, $A_z$, $A_3$, $A_4$, $A_5$, $A_6$, $A_7$, and/or $A_8$ are mixtures of ethylene, propylene, and/or butylene, the resulting alkoxylate may have a block-wise structure or a random structure.

For a non-limiting illustration, when w=7 in the polyetheramine according to Formula (I), then the polyetheramine comprises six [$A_1$-O] groups. If $A_1$ comprises a mixture of ethylene groups and propylene groups, then the resulting polyetheramine would comprise a mixture of ethoxy (EO) groups and propoxy (PO) groups. These groups may be arranged in a random structure (e.g., EO-EO-PO-EO-PO-PO) or a block-wise structure (EO-EO-EO-PO-PO-PO). In this illustrative example, there are an equal number of different alkoxy groups (here, three EO and three PO), but there may also be different numbers of each alkoxy group (e.g., five EO and one PO). Furthermore, when the polyetheramine comprises alkoxy groups in a block-wise structure, the polyetheramine may comprise two blocks, as shown in the illustrative example (where the three EO groups form one block and the three PO groups form another block), or the polyetheramine may comprise more than two blocks.

The sum of x+y+w+z may be in the range of from about 4 to about 100, or from about 4 to about 30, or from about 4 to about 10, or from about 5 to about 10. The sum of x'+y'+w'+z' may be in the range of from about 4 to about 100, or from about 4 to about 30, or from about 4 to about 10, or from about 5 to about 10.

The polyetheramines of the present invention may have a weight average molecular weight of from about 350, or from about 400, or from about 500, or from about 600, or from about 650 grams/mole, to about 1000, or to about 800, or to about 750 grams/mole. The molecular mass of a polymer differs from typical molecules in that polymerization reactions produce a distribution of molecular weights, which is summarized by the weight average molecular weight. The polyetheramine polymers of the invention are thus distributed over a range of molecular weights. Differences in the molecular weights are primarily attributable to differences in the number of monomer units that sequence together during synthesis. With regard to the polyetheramine polymers of the invention, the monomer units are the alkylene oxides that react with the polyols of Formula (II) to form alkoxylated polyols, which are then aminated to form the resulting polyetheramine polymers. The resulting polyetheramine polymers are characterized by the sequence of alkylene oxide units. The alkoxylation reaction results in a distribution of sequences of alkylene oxide and, hence, a distribution of molecular weights. The alkoxylation reaction also produces unreacted alkylene oxide monomer ("unreacted monomers") that do not react during the reaction and remain in the composition.

In the polyetheramine of Formula (I), each of $k_1$, $k_2$, $k_3$, and $k_4$ may be 1, and the molecular weight of the polyetheramine may be from about 400 to about 800 grams/mole. In the polyetheramine of Formula (I), each of $k_1$, $k_2$, $k_3$, and $k_4$ may be 1, and at least one of $A_1$, $A_2$, $A_3$, $A_4$, $A_5$, $A_6$, $A_7$, $A_8$, $A_9$, $A_{10}$, $A_{11}$, or $A_{12}$ may be propylene, butylene, or a mixture thereof. In the polyetheramine of Formula (I), at least one of $A_1$, $A_2$, $A_3$, $A_4$, $A_5$, $A_6$, $A_7$, $A_8$, $A_9$, $A_{10}$, $A_{11}$, or $A_{12}$ may be butylene.

The composition may comprise a polyetheramine selected from the group consisting of Formula A, Formula B, Formula C, Formula D, Formula E, and mixtures thereof:

Formula A

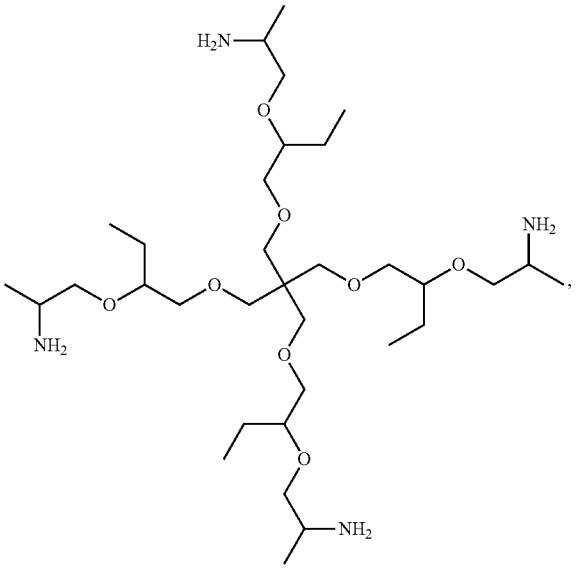

-continued

Formula B

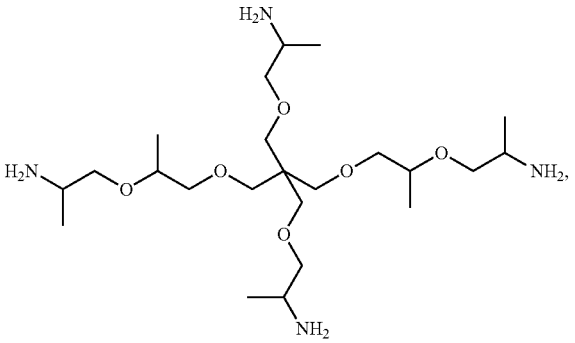

Formula C

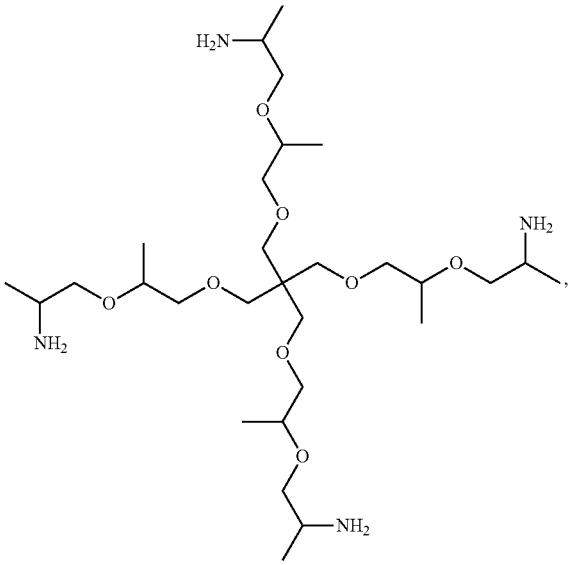

Formula D

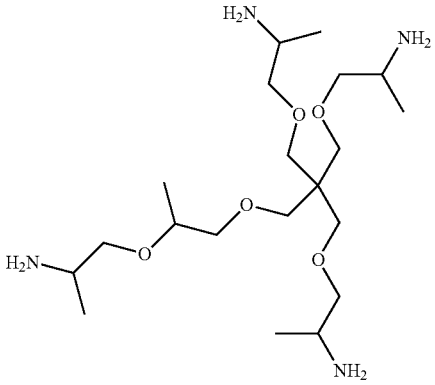

-continued

Formula E

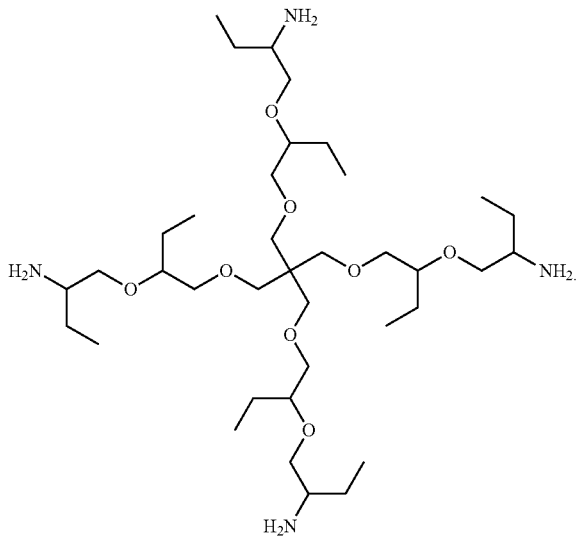

The polyetheramines of the present invention, for example the polyetheramine of Formula (I), may be obtained by a process comprising the following steps:

a) reacting a polyol, with $C_2$-$C_{18}$ alkylene oxide, to form an alkoxylated polyol, where the molar ratio of the polyol to the alkylene oxide is in the range of about 1:3 to about 1:10, and b) aminating the alkoxylated polyol with ammonia.

This process is described in more detail below.

Alkoxylation

Polyetheramines according to Formula (I) may be obtained by reductive amination of an alkoxylated polyol. Alkoxylated polyols according to the present disclosure may be obtained by reaction of polyols with alkylene oxides according to general alkoxylation procedures known in the art.

The polyol may be water soluble.

The polyol may have the structure of Formula (II):

Formula (II)

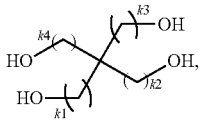

where each of $k_1$, $k_2$, $k_3$, and $k_4$ is independently selected from 0, 1, 2, 3, 4, 5, or 6. $k_1$, $k_2$, $k_3$, and $k_4$ may be each independently selected from 0, 1, or 2. Each of $k_1$, $k_2$, $k_3$, and $k_4$ may be independently selected from 0 or 1. At least two of $k_1$, $k_2$, $k_3$, and $k_4$ may be 1. Each of $k_1$, $k_2$, $k_3$, and $k_4$ may be 1.

The alkoxylated polyol may be prepared in a known manner by reaction of the polyol with an alkylene oxide. Suitable alkylene oxides are linear or branched $C_2$-$C_{18}$ alkylene oxides, typically $C_2$-$C_{10}$ alkylene oxides, more typically $C_2$-$C_6$ alkylene oxides or $C_2$-$C_4$ alkylene oxides. Suitable alkylene oxides include ethylene oxide, propylene oxide, butylene oxide, pentene oxide, hexene oxide, decene oxide, and dodecene oxide. The $C_2$-$C_{18}$ alkylene oxide may be selected from ethylene oxide, propylene oxide, butylene oxide, or a mixture thereof. The $C_2$-$C_{18}$ alkylene oxide may be butylene oxide, optionally in combination with other $C_2$-$C_{18}$ alkylene oxides.

The polyol may be reacted with one single type of alkylene oxide or combinations of two or more different types of alkylene oxides, e.g., ethylene oxide and propylene oxide. If two or more different types of alkylene oxides are used, the resulting alkoxylate may have a block-wise structure or a random structure.

Typically, the molar ratio of polyol to $C_2$-$C_{18}$ alkylene oxide at which the alkoxylation reaction is carried out is in the range of about 1:3 to about 1:10, or about 1:3 to about 1:6, or about 1:4 to about 1:6. The molar ratio of polyol to $C_2$-$C_{18}$ alkylene oxide at which the alkoxylation reaction is carried out may be in the range of about 1:5 to about 1:10.

The reaction is generally performed in the presence of a catalyst in an aqueous solution at a reaction temperature of from about 70° C. to about 200° C., and typically from about 80° C. to about 160° C. The reaction may proceed at a pressure of up to about 10 bar, or up to about 8 bar.

Examples of suitable catalysts include basic catalysts, such as alkali metal and alkaline earth metal hydroxides, e.g., sodium hydroxide, potassium hydroxide and calcium hydroxide, alkali metal alkoxides, in particular sodium and potassium $C_1$-$C_4$-alkoxides, e.g., sodium methoxide, sodium ethoxide and potassium tert-butoxide, alkali metal and alkaline earth metal hydrides, such as sodium hydride and calcium hydride, and alkali metal carbonates, such as sodium carbonate and potassium carbonate. The catalyst may be an alkali metal hydroxide, typically potassium hydroxide or sodium hydroxide. Typical use amounts for the catalyst are from about 0.05 to about 10% by weight, in particular from about 0.1 to about 2% by weight, based on the total amount of the polyol and the alkylene oxide. During the alkoxylation reaction, certain impurities—unintended constituents of the polymer—may be formed, such as catalysts residues.

Amination

Polyetheramines according to Formula (I) may be obtained by reductive amination of an alkoxylated polyol with ammonia in the presence of hydrogen and a catalyst, such as a catalyst containing nickel. Suitable catalysts are described in WO 2011/067199 A1, in WO2011/067200 A1, and in EP0696572B1.

The amination may be carried out in the presence of copper-, nickel- or cobalt-containing catalyst. Preferred catalysts are supported copper-, nickel- and cobalt-containing catalysts, wherein the catalytically active material of the catalyst, before the reduction thereof with hydrogen, comprises oxygen compounds of aluminum, copper, nickel and cobalt, and, in the range of from about 0.2% to about 5.0% by weight, of oxygen compounds of tin, calculated as SnO. Other suitable catalysts are supported copper-, nickel- and cobalt-containing catalysts, where the catalytically active material of the catalyst, before the reduction thereof with hydrogen, comprises oxygen compounds of aluminum, copper, nickel, cobalt, tin, and, in the range of from about 0.2 to about 5.0% by weight, of oxygen compounds of yttrium, lanthanum, cerium and/or hafnium, each calculated as $Y_2O_3$, $La_2O_3$, $Ce_2O_3$ and $Hf_2O_3$, respectively. Another suitable catalyst is a zirconium, copper, nickel catalyst, wherein the catalytically active composition comprises from about 20 to about 85% by weight of oxygen-containing zirconium compounds, calculated as $ZrO_2$, from about 1 to about 30% by weight of oxygen-containing compounds of copper, calculated as CuO, from about 30 to about 70% by weight of oxygen-containing compounds of nickel, calculated as NiO, from about 0.1 to about 5% by weight of oxygen-containing compounds of aluminium and/or manganese, calculated as $Al_2O_3$ and $MnO_2$, respectively.

For the reductive amination step, a supported as well as a non-supported catalyst can be used. The supported catalyst may be obtained by deposition of the metallic components of the catalyst compositions onto support materials known to those skilled in the art, using techniques that are well-known in the art, including, without limitation, known forms of alumina, silica, charcoal, carbon, graphite, clays, mordenites; molecular sieves may be used to provide supported catalysts as well. When the catalyst is supported, the support particles of the catalyst may have any geometric shape, for example, the shape of spheres, tablets, or cylinders in a regular or irregular version.

The process can be carried out in a continuous or discontinuous mode, e.g., in an autoclave, tube reactor, or fixed-bed reactor. A number of reactor designs may be used. For example, the feed thereto may be upflowing or downflowing, and design features in the reactor that optimize plug flow in the reactor may be employed.

The degree of amination may be from about 50% to about 100%, or from about 67% to about 100%, or from about 85% to about 100%. The degree of amination may be less than 50%. The degree of amination may be from about 10% to less than 50%, or from about 20% to less than 50%, or from about 30% to less than 50%.

Unless specified otherwise herein, the degree of amination is calculated from the total amine value (AZ) divided by sum of the total acetylables value (AC) and tertiary amine value (tert. AZ) multiplied by 100 (Total AZ/((AC+tert. AZ)×100)).

The total amine value (AZ) is determined according to DIN 16945.

The total acetylables value (AC) is determined according to DIN 53240.

The secondary and tertiary amines are determined according to ASTM D2074-07.

The hydroxyl value is calculated from (total acetylables value+tertiary amine value)−total amine value.

The polyetheramines of the invention are effective for removal of stains, particularly grease, from soiled material. Cleaning compositions containing the polyetheramines of the invention also do not exhibit the cleaning negatives seen with conventional amine-containing cleaning compositions on hydrophilic bleachable stains, such as coffee, tea, wine, or particulates. Additionally, unlike conventional amine-containing cleaning compositions, the cleaning compositions containing polyetheramines of the invention do not contribute to whiteness negatives on white fabrics.

The polyetheramines of the invention may be used in the form of a water-based, water-containing, or water-free solution, emulsion, gel or paste of the polyetheramine together with an acid such as, for example, citric acid, lactic acid, sulfuric acid, methanesulfonic acid, hydrogen chloride, e.g., aqeous hydrogen chloride, phosphoric acid, or mixtures thereof. Alternatively, the acid may be represented by a surfactant, such as, alkyl benzene sulphonic acid, alkylsulphonic acid, monoalkyl esters of sulphuric acid, mono alkylethoxy esters of sulphuric acid, fatty acids, alkyl ethoxy carboxylic acids, and the like, or mixtures thereof. When applicable or measurable, the preferred pH of the solution or emulsion ranges from pH 3 to pH 11, or from pH 6 to pH 9.5, even more preferred from pH 7 to pH 8.5.

A further advantage of cleaning compositions containing the polyetheramines of the invention is their ability to remove grease stains in cold water, for example, as a detergent in the wash water or via pretreatment of a grease stain followed by cold water washing. Without being limited by theory, it is believed that cold water washing solutions have the effect of hardening or solidifying grease, making the grease more resistant to removal, especially on fabric. Cleaning compositions containing the polyetheramines of the invention are surprisingly effective when used as part of a pretreatment regimen followed by cold water washing.

Surfactant

The cleaning composition comprises one or more surfactants. The cleaning composition may comprise, by weight of the composition, from about 1% to about 70% of a surfactant. The cleaning composition may comprise, by weight of the composition, from about 2% to about 60% of the surfactant. The cleaning composition may comprise, by weight of the composition, from about 5% to about 30% of the surfactant. The surfactant may be selected from the group consisting of anionic surfactants, nonionic surfactants, cationic surfactants, zwitterionic surfactants, amphoteric surfactants, ampholytic surfactants, and mixtures thereof. The surfactant may be a detersive surfactant, which encompasses any surfactant or mixture of surfactants that provide cleaning, stain removing, or laundering benefit to soiled material.

Anionic Surfactants

The cleaning composition may comprise an anionic surfactant. The cleaning composition may consist essentially of, or even consist of, an anionic surfactant.

Specific, non-limiting examples of suitable anionic surfactants include any conventional anionic surfactant. This may include a sulfate detersive surfactant, for e.g., alkoxylated and/or non-alkoxylated alkyl sulfate materials, and/or sulfonic detersive surfactants, e.g., alkyl benzene sulfonates.

Alkoxylated alkyl sulfate materials comprise ethoxylated alkyl sulfate surfactants, also known as alkyl ether sulfates or alkyl polyethoxylate sulfates. Examples of ethoxylated alkyl sulfates include water-soluble salts, particularly the alkali metal, ammonium and alkylolammonium salts, of organic sulfuric reaction products having in their molecular structure an alkyl group containing from about 8 to about 30 carbon atoms and a sulfonic acid and its salts. (Included in the term "alkyl" is the alkyl portion of acyl groups. In some examples, the alkyl group contains from about 15 carbon atoms to about 30 carbon atoms. In other examples, the alkyl ether sulfate surfactant may be a mixture of alkyl ether sulfates, said mixture having an average (arithmetic mean) carbon chain length within the range of about 12 to 30 carbon atoms, and in some examples an average carbon chain length of about 25 carbon atoms, and an average (arithmetic mean) degree of ethoxylation of from about 1 mol to 4 mols of ethylene oxide, and in some examples an average (arithmetic mean) degree of ethoxylation of 1.8 mols of ethylene oxide. In further examples, the alkyl ether sulfate surfactant may have a carbon chain length between about 10 carbon atoms to about 18 carbon atoms, and a degree of ethoxylation of from about 1 to about 6 mols of ethylene oxide. In yet further examples, the alkyl ether sulfate surfactant may contain a peaked ethoxylate distribution.

Non-alkoxylated alkyl sulfates may also be added to the disclosed detergent compositions and used as an anionic surfactant component. Examples of non-alkoxylated, e.g., non-ethoxylated, alkyl sulfate surfactants include those produced by the sulfation of higher $C_8$-$C_{20}$ fatty alcohols. In some examples, primary alkyl sulfate surfactants have the general formula: $ROSO_3^-M^+$, wherein R is typically a linear $C_8$-$C_{20}$ hydrocarbyl group, which may be straight chain or branched chain, and M is a water-solubilizing cation. In some examples, R is a $C_{10}$-$C_{15}$ alkyl, and M is an alkali metal. In other examples, R is a $C_{12}$-$C_{14}$ alkyl and M is sodium.

Other useful anionic surfactants can include the alkali metal salts of alkyl benzene sulfonates, in which the alkyl group contains from about 9 to about 15 carbon atoms, in straight chain (linear) or branched chain configuration. In some examples, the alkyl group is linear. Such linear alkylbenzene sulfonates are known as "LAS." In other examples, the linear alkylbenzene sulfonate may have an average number of carbon atoms in the alkyl group of from about 11 to 14. In a specific example, the linear straight chain alkyl benzene sulfonates may have an average number of carbon atoms in the alkyl group of about 11.8 carbon atoms, which may be abbreviated as C11.8 LAS.

Suitable alkyl benzene sulphonate (LAS) may be obtained, by sulphonating commercially available linear alkyl benzene (LAB); suitable LAB includes low 2-phenyl LAB, such as those supplied by Sasol under the tradename Isochem® or those supplied by Petresa under the tradename Petrelab®, other suitable LAB include high 2-phenyl LAB, such as those supplied by Sasol under the tradename Hyblene®. A suitable anionic detersive surfactant is alkyl benzene sulphonate that is obtained by DETAL catalyzed process, although other synthesis routes, such as HF, may also be suitable. A magnesium salt of LAS may be used.

The detersive surfactant may be a mid-chain branched detersive surfactant, e.g., a mid-chain branched anionic detersive surfactant, such as a mid-chain branched alkyl sulphate and/or a mid-chain branched alkyl benzene sulphonate.

Other anionic surfactants useful herein are the water-soluble salts of: paraffin sulfonates and secondary alkane sulfonates containing from about 8 to about 24 (and in some examples about 12 to 18) carbon atoms; alkyl glyceryl ether sulfonates, especially those ethers of $C_{8-18}$ alcohols (e.g., those derived from tallow and coconut oil). Mixtures of the alkylbenzene sulfonates with the above-described paraffin sulfonates, secondary alkane sulfonates and alkyl glyceryl ether sulfonates are also useful. Further suitable anionic surfactants include methyl ester sulfonates and alkyl ether carboxylates.

The anionic surfactants may exist in an acid form, and the acid form may be neutralized to form a surfactant salt. Typical agents for neutralization include metal counterion bases, such as hydroxides, e.g., NaOH or KOH. Further suitable agents for neutralizing anionic surfactants in their acid forms include ammonia, amines, or alkanolamines. Non-limiting examples of alkanolamines include monoethanolamine, diethanolamine, triethanolamine, and other linear or branched alkanolamines known in the art; suitable alkanolamines include 2-amino-1-propanol, 1-aminopropanol, monoisopropanolamine, or 1-amino-3-propanol. Amine neutralization may be done to a full or partial extent, e.g., part of the anionic surfactant mix may be neutralized with sodium or potassium and part of the anionic surfactant mix may be neutralized with amines or alkanol amines.

Nonionic Surfactants

The cleaning composition may comprise a nonionic surfactant. The cleaning composition may comprise from about 0.1% to about 50%, by weight of the cleaning composition, of a nonionic surfactant. The cleaning composition may comprise from about 0.1% to about 25% or about 0.1% to about 15%, by weight of the cleaning composition, of a nonionic surfactants. The cleaning composition may comprise from about 0.3% to about 10%, by weight of the cleaning composition, of a nonionic surfactant.

Suitable nonionic surfactants useful herein can comprise any conventional nonionic surfactant. These can include, for e.g., alkoxylated fatty alcohols and amine oxide surfactants. In some examples, the detergent compositions may contain an ethoxylated nonionic surfactant. The nonionic surfactant may be selected from the ethoxylated alcohols and ethoxylated alkyl phenols of the formula $R(OC_2H_4)_nOH$, wherein R is selected from the group consisting of aliphatic hydrocarbon radicals containing from about 8 to about 15 carbon atoms and alkyl phenyl radicals in which the alkyl groups contain from about 8 to about 12 carbon atoms, and the average value of n is from about 5 to about 15. The nonionic surfactant may b selected from ethoxylated alcohols having an average of about 24 carbon atoms in the alcohol and an average degree of ethoxylation of about 9 moles of ethylene oxide per mole of alcohol.

Other non-limiting examples of nonionic surfactants useful herein include: $C_8$-$C_{18}$ alkyl ethoxylates, such as, NEODOL® nonionic surfactants from Shell; $C_6$-$C_{12}$ alkyl phenol alkoxylates where the alkoxylate units may be ethyleneoxy units, propyleneoxy units, or a mixture thereof; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols, BA; $C_{14}$-$C_{22}$ mid-chain branched alkyl alkoxylates, $BAE_x$, wherein x is from 1 to 30; alkylpolysaccharides; specifically alkylpolyglycosides; polyhydroxy fatty acid amides; and ether capped poly(oxyalkylated) alcohol surfactants.

Suitable nonionic detersive surfactants also include alkyl polyglucoside and alkyl alkoxylated alcohol. Suitable nonionic surfactants also include those sold under the tradename Lutensol® from BASF.

The nonionic surfactant may be selected from alkyl alkoxylated alcohols, such as a $C_{8-18}$ alkyl alkoxylated alcohol, for example, a $C_{8-18}$ alkyl ethoxylated alcohol. The alkyl alkoxylated alcohol may have an average degree of alkoxylation of from about 1 to about 50, or from about 1 to about 30, or from about 1 to about 20, or from about 1 to about 10, or from about 1 to about 7, or from about 1 to about 5, or from about 3 to about 7. The alkyl alkoxylated alcohol can be linear or branched, substituted or unsubstituted.

Cationic Surfactants

The cleaning composition may comprise a cationic surfactant. The cleaning composition may comprise from about 0.1% to about 10%, or from about 0.1% to about 7%, or from about 0.1% to about 5%, or from about 1% to about 4%, by weight of the cleaning composition, of a cationic surfactant. The cleaning compositions of the invention may be substantially free of cationic surfactants and surfactants that become cationic below a pH of 7 or below a pH of 6.

Non-limiting examples of cationic surfactants include: the quaternary ammonium surfactants, which can have up to 26 carbon atoms include: alkoxylate quaternary ammonium (AQA) surfactants; dimethyl hydroxyethyl quaternary ammonium; dimethyl hydroxyethyl lauryl ammonium chloride; polyamine cationic surfactants; cationic ester surfactants; and amino surfactants, e.g., amido propyldimethyl amine (APA).

Suitable cationic detersive surfactants also include alkyl pyridinium compounds, alkyl quaternary ammonium compounds, alkyl quaternary phosphonium compounds, alkyl ternary sulphonium compounds, and mixtures thereof.

Suitable cationic detersive surfactants are quaternary ammonium compounds having the general formula:

$$(R)(R_1)(R_2)(R_3)N^+X^-$$

wherein, R is a linear or branched, substituted or unsubstituted $C_{6-18}$ alkyl or alkenyl moiety, $R_1$ and $R_2$ are independently selected from methyl or ethyl moieties, $R_3$ is a hydroxyl, hydroxymethyl or a hydroxyethyl moiety, X is an anion which provides charge neutrality, suitable anions include: halides, for example chloride; sulphate; and sulphonate. Suitable cationic detersive surfactants are mono-$C_{6-18}$ alkyl mono-hydroxyethyl di-methyl quaternary ammonium chlorides. Highly suitable cationic detersive surfactants are mono-$C_{8-10}$ alkyl mono-hydroxyethyl di-methyl quaternary ammonium chloride, mono-$C_{10-12}$ alkyl mono-hydroxyethyl di-methyl quaternary ammonium chloride and mono-$C_{10}$ alkyl mono-hydroxyethyl di-methyl quaternary ammonium chloride.

Zwitterionic Surfactants

The cleaning composition may comprise a zwitterionic surfactant. Examples of zwitterionic surfactants include: derivatives of secondary and tertiary amines, derivatives of heterocyclic secondary and tertiary amines, or derivatives of quaternary ammonium, quaternary phosphonium or tertiary sulfonium compounds. Suitable examples of zwitterionic surfactants include betaines, including alkyl dimethyl betaine and cocodimethyl amidopropyl betaine, $C_8$ to $C_{18}$ (for example from $C_{12}$ to $C_{18}$) amine oxides, and sulfo and hydroxy betaines, such as N-alkyl-N,N-dimethylammino-1-propane sulfonate where the alkyl group can be $C_8$ to $C_{18}$.

Amphoteric Surfactants

The cleaning composition may comprise an amphoteric surfactant. Examples of amphoteric surfactants include aliphatic derivatives of secondary or tertiary amines, or aliphatic derivatives of heterocyclic secondary and tertiary amines in which the aliphatic radical may be straight or branched-chain and where one of the aliphatic substituents contains at least about 8 carbon atoms, or from about 8 to about 18 carbon atoms, and at least one of the aliphatic substituents contains an anionic water-solubilizing group, e.g. carboxy, sulfonate, sulfate. Examples of compounds falling within this definition are sodium 3-(dodecylamino)propionate, sodium 3-(dodecylamino) propane-1-sulfonate, sodium 2-(dodecylamino)ethyl sulfate, sodium 2-(dimethylamino) octadecanoate, disodium 3-(N-carboxymethyldodecylamino)propane 1-sulfonate, disodium octadecyl-imminodiacetate, sodium 1-carboxymethyl-2-undecylimidazole, and sodium N,N-bis(2-hydroxyethyl)-2-sulfato-3-dodecoxypropylamine. Suitable amphoteric surfactants also include sarcosinates, glycinates, taurinates, and mixtures thereof.

Branched Surfactants

The cleaning composition may comprise a branched surfactant. Suitable branched surfactants include anionic branched surfactants selected from branched sulphate or branched sulphonate surfactants, e.g., branched alkyl sulphate, branched alkyl alkoxylated sulphate, and branched alkyl benzene sulphonates, comprising one or more random alkyl branches, e.g., $C_{14}$ alkyl groups, typically methyl and/or ethyl groups.

The branched detersive surfactant may be a mid-chain branched detersive surfactant, e.g., a mid-chain branched anionic detersive surfactant, such as a mid-chain branched alkyl sulphate and/or a mid-chain branched alkyl benzene sulphonate.

The branched surfactant may comprise a longer alkyl chain, mid-chain branched surfactant compound of the formula:

$$A_b\text{-X-B}$$

where:

(a) $A_b$ is a hydrophobic C9 to C22 (total carbons in the moiety), typically from about C12 to about C18, mid-chain branched alkyl moiety having: (1) a longest linear carbon chain attached to the —X—B moiety in the range of from 8 to 21 carbon atoms; (2) one or more C1-C3 alkyl moieties branching from this longest linear carbon chain; (3) at least one of the branching alkyl moieties is attached directly to a carbon of the longest linear carbon chain at a position within the range of position 2 carbon (counting from carbon #1 which is attached to the —X—B moiety) to position ω−2 carbon (the terminal carbon minus 2 carbons, i.e., the third carbon from the end of the longest linear carbon chain); and (4) the surfactant composition has an average total number of carbon atoms in the $A_b$-X moiety in the above formula within the range of greater than 14.5 to about 17.5 (typically from about 15 to about 17);

b) B is a hydrophilic moiety selected from sulfates, sulfonates, amine oxides, polyoxyalkylene (such as polyoxyethylene and polyoxypropylene), alkoxylated sulfates, polyhydroxy moieties, phosphate esters, glycerol sulfonates, polygluconates, polyphosphate esters, phosphonates, sulfosuccinates, sulfosuccaminates, polyalkoxylated carboxylates, glucamides, taurinates, sarcosinates, glycinates, isethionates, dialkanolamides, monoalkanolamides, monoalkanolamide sulfates, diglycolamides, diglycolamide sulfates, glycerol esters, glycerol ester sulfates, glycerol ethers, glycerol ether sulfates, polyglycerol ethers, polyglycerol ether sulfates, sorbitan esters, polyalkoxylated sorbitan esters, ammonioalkanesulfonates, amidopropyl betaines, alkylated quats, alkylated/polyhydroxyalkylated quats, alkylated/polyhydroxylated oxypropyl quats, imidazolines, 2-ylsuccinates, sulfonated alkyl esters, and sulfonated fatty acids (it is to be noted that more than one hydrophobic moiety may be attached to B, for example as in $(A_b\text{-X})_z$-B to give dimethyl quats); and (c) X is selected from —CH2- and —C(O)—.

Generally, in the above formula the $A_b$ moiety does not have any quaternary substituted carbon atoms (i.e., 4 carbon atoms directly attached to one carbon atom). Depending on which hydrophilic moiety (B) is selected, the resultant surfactant may be anionic, nonionic, cationic, zwitterionic, amphoteric, or ampholytic. B may be a sulfate and the resultant surfactant may be anionic.

The branched surfactant may comprise a longer alkyl chain, mid-chain branched surfactant compound of the above formula wherein the $A_b$ moiety is a branched primary alkyl moiety having the formula:

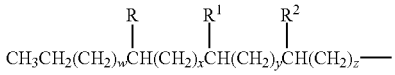

wherein the total number of carbon atoms in the branched primary alkyl moiety of this formula (including the R, $R^1$, and $R^2$ branching) is from 13 to 19; R, R1, and R2 are each independently selected from hydrogen and C1-C3 alkyl (typically methyl), provided R, R1, and R2 are not all hydrogen and, when z is 0, at least R or R1 is not hydrogen; w is an integer from 0 to 13; x is an integer from 0 to 13; y is an integer from 0 to 13; z is an integer from 0 to 13; and w+x+y+z is from 7 to 13.

The branched surfactant may comprise a longer alkyl chain, mid-chain branched surfactant compound of the above formula wherein the $A_b$ moiety is a branched primary alkyl moiety having the formula selected from:

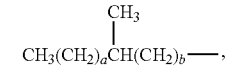

(I)

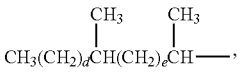

(II)

or mixtures thereof; wherein a, b, d, and e are integers, a+b is from 10 to 16, d+e is from 8 to 14 and wherein further when a+b=10, a is an integer from 2 to 9 and b is an integer from 1 to 8;

when a+b=11, a is an integer from 2 to 10 and b is an integer from 1 to 9;

when a+b=12, a is an integer from 2 to 11 and b is an integer from 1 to 10;

when a+b=13, a is an integer from 2 to 12 and b is an integer from 1 to 11;

when a+b=14, a is an integer from 2 to 13 and b is an integer from 1 to 12;

when a+b=15, a is an integer from 2 to 14 and b is an integer from 1 to 13;

when a+b=16, a is an integer from 2 to 15 and b is an integer from 1 to 14;

when d+e=8, d is an integer from 2 to 7 and e is an integer from 1 to 6;

when d+e=9, d is an integer from 2 to 8 and e is an integer from 1 to 7;

when d+e=10, d is an integer from 2 to 9 and e is an integer from 1 to 8;

when d+e=11, d is an integer from 2 to 10 and e is an integer from 1 to 9;

when d+e=12, d is an integer from 2 to 11 and e is an integer from 1 to 10;

when d+e=13, d is an integer from 2 to 12 and e is an integer from 1 to 11;

when d+e=14, d is an integer from 2 to 13 and e is an integer from 1 to 12.

In the mid-chain branched surfactant compounds described above, certain points of branching (e.g., the location along the chain of the R, $R^1$, and/or $R^2$ moieties in the above formula) are preferred over other points of branching along the backbone of the surfactant. The formula below illustrates the mid-chain branching range (i.e., where points of branching occur), preferred mid-chain branching range, and more preferred mid-chain branching range for mono-methyl branched alkyl $A^b$ moieties.

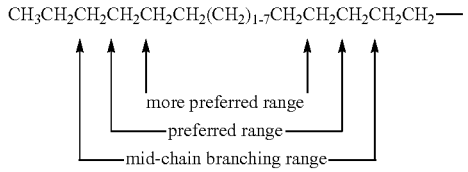

For mono-methyl substituted surfactants, these ranges exclude the two terminal carbon atoms of the chain and the carbon atom immediately adjacent to the -X-B group.

The formula below illustrates the mid-chain branching range, preferred mid-chain branching range, and more preferred mid-chain branching range for di-methyl substituted alkyl $A^b$ moieties.

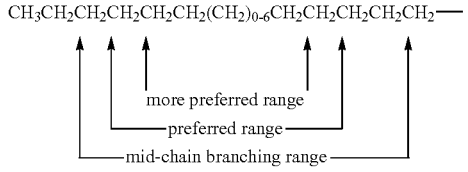

The branched anionic surfactant may comprise a branched modified alkylbenzene sulfonate (MLAS).

The branched anionic surfactant may comprise a C12/13 alcohol-based surfactant comprising a methyl branch randomly distributed along the hydrophobe chain, e.g., Safol®, Marlipal® available from Sasol.

Additional suitable branched anionic detersive surfactants include surfactant derivatives of isoprenoid-based polybranched detergent alcohols. Isoprenoid-based surfactants and isoprenoid derivatives are also described in the book entitled "Comprehensive Natural Products Chemistry: Isoprenoids Including Carotenoids and Steroids (Vol. two)", Barton and Nakanishi, © 1999, Elsevier Science Ltd and are included in the structure E, and are hereby incorporated by reference.

Further suitable branched anionic detersive surfactants include those derived from anteiso and iso-alcohols.

Suitable branched anionic surfactants also include Guerbet-alcohol-based surfactants. Guerbet alcohols are branched, primary monofunctional alcohols that have two linear carbon chains with the branch point always at the second carbon position. Guerbet alcohols are chemically described as 2-alkyl-1-alkanols. Guerbet alcohols generally have from 12 carbon atoms to 36 carbon atoms. The Guerbet alcohols may be represented by the following formula: (R1)(R2)$CHCH_2OH$, where R1 is a linear alkyl group, R2 is a linear alkyl group, the sum of the carbon atoms in R1 and R2 is 10 to 34, and both R1 and R2 are present. Guerbet alcohols are commercially available from Sasol as Isofol® alcohols and from Cognis as Guerbetol.

Each of the branched surfactants described above may include a bio-based content. The branched surfactant may have a bio-based content of at least about 50%, at least about 60%, at least about 70%, at least about 80%, at least about 90%, at least about 95%, at least about 97%, or about 100%.

Anionic/Nonionic Combinations

The cleaning composition may comprise a combination of anionic and nonionic surfactants. The weight ratio of anionic surfactant to nonionic surfactant may be at least about 2:1. The weight ratio of anionic surfactant to nonionic surfactant may be at least about 5:1. The weight ratio of anionic surfactant to nonionic surfactant may be at least about 10:1.

Combinations of Surfactants

The cleaning composition may comprise an anionic surfactant and a nonionic surfactant, for example, a $C_{12}$-$C_{18}$ alkyl ethoxylate. The cleaning composition may comprise $C_{10}$-$C_{15}$ alkyl benzene sulfonates (LAS) and another anionic surfactant, e.g., $C_{10}$-$C_{18}$ alkyl alkoxy sulfates ($AE_xS$), where x is from 1-30. The cleaning composition may comprise an anionic surfactant and a cationic surfactant, for example, dimethyl hydroxyethyl lauryl ammonium chloride. The cleaning composition may comprise an anionic surfactant and a zwitterionic surfactant, for example, C12-C14 dimethyl amine oxide.

Adjunct Cleaning Additives

The cleaning compositions of the invention may also contain adjunct cleaning additives. Suitable adjunct cleaning additives include builders, structurants or thickeners, clay soil removal/anti-redeposition agents, polymeric soil release agents, polymeric dispersing agents, polymeric grease cleaning agents, enzymes, enzyme stabilizing systems, bleaching compounds, bleaching agents, bleach activators, bleach catalysts, brighteners, dyes, hueing agents, dye transfer inhibiting agents, chelating agents, suds supressors, softeners, and perfumes.

Enzymes

The detergent compositions described herein may comprise one or more enzymes which provide cleaning performance and/or fabric care benefits. Examples of suitable enzymes include, but are not limited to, hemicellulases, peroxidases, proteases, cellulases, xylanases, lipases, phospholipases, esterases, cutinases, pectinases, mannanases, pectate lyases, keratinases, reductases, oxidases, phenoloxidases, lipoxygenases, ligninases, pullulanases, tannases, pentosanases, malanases, β-glucanases, arabinosidases, hyaluronidase, chondroitinase, laccase, and amylases, or mixtures thereof. A typical combination is an enzyme cocktail that may comprise, for example, a protease and lipase in conjunction with amylase. When present in a detergent composition, the aforementioned additional enzymes may be present at levels from about 0.00001% to about 2%, from about 0.0001% to about 1% or even from about 0.001% to about 0.5% enzyme protein by weight of the detergent composition.

The enzyme may be a protease. Suitable proteases include metalloproteases and serine proteases, including neutral or alkaline microbial serine proteases, such as subtilisins (EC 3.4.21.62). Suitable proteases include those of animal, vegetable or microbial origin. A suitable protease may be of microbial origin. The suitable proteases include chemically or genetically modified mutants of the aforementioned suitable proteases. The suitable protease may be a serine protease, such as an alkaline microbial protease or/and a trypsin-type protease. Examples of suitable neutral or alkaline proteases include:

(a) subtilisins (EC 3.4.21.62), including those derived from *Bacillus*, such as *Bacillus lentus, B. alkalophilus, B. subtilis, B. amyloliquefaciens, Bacillus pumilus* and *Bacillus gibsonii* described in U.S. Pat. No. 6,312,936B1, U.S. Pat. No. 5,679,630, U.S. Pat. No. 4,760,025, U.S. Pat. No. 7,262,042 and WO09/021867.

(b) trypsin-type or chymotrypsin-type proteases, such as trypsin (e.g., of porcine or bovine origin), including the *Fusarium* protease described in WO 89/06270 and the chymotrypsin proteases derived from Cellumonas described in WO 05/052161 and WO 05/052146.

(c) metalloproteases, including those derived from *Bacillus amyloliquefaciens* described in WO 07/044993A2.

Preferred proteases include those derived from *Bacillus gibsonii* or *Bacillus Lentus*. Suitable commercially available protease enzymes include those sold under the trade names Alcalase®, Savinase®, Primase®, Durazym®, Polarzyme®, Kannase®, Liquanase®, Liquanase Ultra®, Savinase Ultra®, Ovozyme®, Neutrase®, Everlase® and Esperase® by Novozymes A/S (Denmark), those sold under the tradename Maxatase®, Maxacal®, Maxapem®, Properase®, Purafect®, Purafect Prime®, Purafect Ox®, FN3®, FN4®, Excellase® and Purafect OXP® by Genencor International, those sold under the tradename Opticlean® and Optimase® by Solvay Enzymes, those available from Henkel/Kemira, namely BLAP (sequence shown in FIG. 29 of U.S. Pat. No. 5,352,604 with the folowing mutations S99D+S101R+S103A+V104I+G1595, hereinafter referred to as BLAP), BLAP R (BLAP with S3T+V4I+V199M+V2051+L217D), BLAP X (BLAP with S3T+V4I+V2051) and BLAP F49 (BLAP with S3T+V4I+A194P+V199M+V2051+L217D)—all from Henkel/Kemira; and KAP (*Bacillus alkalophilus* subtilisin with mutations A230V+S256G+S259N) from Kao.

Suitable alpha-amylases include those of bacterial or fungal origin. Chemically or genetically modified mutants (variants) are included. A preferred alkaline alpha-amylase is derived from a strain of *Bacillus*, such as *Bacillus licheniformis, Bacillus amyloliquefaciens, Bacillus stearothermophilus, Bacillus subtilis*, or other *Bacillus* sp., such as *Bacillus* sp. NCIB 12289, NCIB 12512, NCIB 12513, DSM 9375 (U.S. Pat. No. 7,153,818) DSM 12368, DSMZ no. 12649, KSM AP1378 (WO 97/00324), KSM K36 or KSM K38 (EP 1,022,334). Preferred amylases include:

(a) the variants described in WO 94/02597, WO 94/18314, WO96/23874 and WO 97/43424, especially the variants with substitutions in one or more of the following positions versus the enzyme listed as SEQ ID No. 2 in WO 96/23874: 15, 23, 105, 106, 124, 128, 133, 154, 156, 181, 188, 190, 197, 202, 208, 209, 243, 264, 304, 305, 391, 408, and 444.

(b) the variants described in U.S. Pat. No. 5,856,164 and WO99/23211, WO 96/23873, WO00/60060 and WO 06/002643, especially the variants with one or more substitutions in the following positions versus the AA560 enzyme listed as SEQ ID No. 12 in WO 06/002643:

26, 30, 33, 82, 37, 106, 118, 128, 133, 149, 150, 160, 178, 182, 186, 193, 203, 214, 231, 256, 257, 258, 269, 270, 272, 283, 295, 296, 298, 299, 303, 304, 305, 311, 314, 315, 318, 319, 339, 345, 361, 378, 383, 419, 421, 437, 441, 444, 445, 446, 447, 450, 461, 471, 482, 484, preferably that also contain the deletions of D183* and G184*.

(c) variants exhibiting at least 90% identity with SEQ ID No. 4 in WO06/002643, the wild-type enzyme from *Bacillus* SP722, especially variants with deletions in the 183 and 184 positions and variants described in WO 00/60060, which is incorporated herein by reference.

(d) variants exhibiting at least 95% identity with the wild-type enzyme from *Bacillus* sp.707 (SEQ ID NO:7 in U.S. Pat. No. 6,093,562), especially those comprising one or more of the following mutations M202, M208, 5255, R172, and/or M261. Preferably said amylase comprises one or more of M202L, M202V, M2025, M202T, M202I, M202Q, M202W, S255N and/or R172Q. Particularly preferred are those comprising the M202L or M202T mutations.

(e) variants described in WO 09/149130, preferably those exhibiting at least 90% identity with SEQ ID NO: 1 or SEQ ID NO:2 in WO 09/149130, the wild-type enzyme from *Geobacillus* Stearophermophilus or a truncated version thereof.

Suitable commercially available alpha-amylases include DURAMYL®, LIQUEZYME®, TERMAMYL®, TERMAMYL ULTRA®, NATALASE®, SUPRAMYL®, STAINZYME®, STAINZYME PLUS®, FUNGAMYL® and BAN® (Novozymes A/S, Bagsvaerd, Denmark), KEMZYM® AT 9000 Biozym Biotech Trading GmbH Wehlistrasse 27b A-1200 Wien Austria, RAPIDASE®, PURASTAR®, ENZYSIZE®, OPTISIZE HT PLUS®, POWERASE® and PURASTAR OXAM® (Genencor International Inc., Palo Alto, Calif.) and KAM® (Kao, 14-10 Nihonbashi Kayabacho, 1-chome, Chuo-ku Tokyo 103-8210, Japan). Suitable amylases include NATALASE®, STAINZYME® and STAINZYME PLUS® and mixtures thereof.

Such enzymes may be selected from the group consisting of: lipases, including "first cycle lipases" such as those described in U.S. Pat. No. 6,939,702B1 and US PA 2009/0217464. In one aspect, the lipase is a first-wash lipase, preferably a variant of the wild-type lipase from *Thermomyces lanuginosus* comprising one or more of the T231R and N233R mutations. The wild-type sequence is the 269 amino acids (amino acids 23-291) of the Swissprot accession number Swiss-Prot 059952 (derived from *Thermomyces lanuginosus* (*Humicola lanuginosa*)). Preferred lipases would include those sold under the tradenames Lipex® and Lipolex®.

Other preferred enzymes include microbial-derived endoglucanases exhibiting endo-beta-1,4-glucanase activity (E.C. 3.2.1.4), including a bacterial polypeptide endogenous to a member of the genus *Bacillus* which has a sequence of at least 90%, 94%, 97% and even 99% identity to the amino acid sequence SEQ ID NO:2 in 7,141,403B2) and mixtures thereof. Suitable endoglucanases are sold under the tradenames Celluclean® and Whitezyme® (Novozymes A/S, Bagsvaerd, Denmark).

Other preferred enzymes include pectate lyases sold under the tradenames Pectawash®, Pectaway®, Xpect® and mannanases sold under the tradenames Mannaway® (all from Novozymes A/S, Bagsvaerd, Denmark), and Purabrite® (Genencor International Inc., Palo Alto, Calif.).

Enzyme Stabilizing System

The detergent compositions may optionally comprise from about 0.001% to about 10%, in some examples from about 0.005% to about 8%, and in other examples, from about 0.01% to about 6%, by weight of the composition, of an enzyme stabilizing system. The enzyme stabilizing system can be any stabilizing system which is compatible with the detersive enzyme. Such a system may be inherently provided by other formulation actives, or be added separately, e.g., by the formulator or by a manufacturer of detergent-ready enzymes. Such stabilizing systems can, for example, comprise calcium ion, boric acid, propylene glycol, short chain carboxylic acids, boronic acids, chlorine bleach scavengers and mixtures thereof, and are designed to address different stabilization problems depending on the type and physical form of the detergent composition. In the case of aqueous detergent compositions comprising protease, a reversible protease inhibitor, such as a boron compound, including borate, 4-formyl phenylboronic acid, phenylboronic acid and derivatives thereof, or compounds such as calcium formate, sodium formate and 1,2-propane diol may be added to further improve stability.

Builders

The detergent compositions of the present invention may optionally comprise a builder. Built detergent compositions typically comprise at least about 1% builder, based on the total weight of the composition. Liquid detergent compositions may comprise up to about 10% builder, and in some examples up to about 8% builder, of the total weight of the composition. Granular detergent compositions may comprise up to about 30% builder, and in some examples up to about 5% builder, by weight of the composition.

Builders selected from aluminosilicates (e.g., zeolite builders, such as zeolite A, zeolite P, and zeolite MAP) and silicates assist in controlling mineral hardness in wash water, especially calcium and/or magnesium, or to assist in the removal of particulate soils from surfaces. Suitable builders may be selected from the group consisting of phosphates, such as polyphosphates (e.g., sodium tri-polyphosphate), especially sodium salts thereof; carbonates, bicarbonates, sesquicarbonates, and carbonate minerals other than sodium carbonate or sesquicarbonate; organic mono-, di-, tri-, and tetracarboxylates, especially water-soluble nonsurfactant carboxylates in acid, sodium, potassium or alkanolammonium salt form, as well as oligomeric or water-soluble low molecular weight polymer carboxylates including aliphatic and aromatic types; and phytic acid. These may be complemented by borates, e.g., for pH-buffering purposes, or by sulfates, especially sodium sulfate and any other fillers or carriers which may be important to the engineering of stable surfactant and/or builder-containing detergent compositions. Additional suitable builders may be selected from citric acid, lactic acid, fatty acid, polycarboxylate builders, for example, copolymers of acrylic acid, copolymers of acrylic acid and maleic acid, and copolymers of acrylic acid and/or maleic acid, and other suitable ethylenic monomers with various types of additional functionalities. Also suitable for use as builders herein are synthesized crystalline ion exchange materials or hydrates thereof having chain structure and a composition represented by the following general anhydride form: $x(M_2O).ySiO_2$-zM'O wherein M is Na and/or K, M' is Ca and/or Mg; y/x is 0.5 to 2.0; and z/x is 0.005 to 1.0 as taught in U.S. Pat. No. 5,427,711.

Alternatively, the composition may be substantially free of builder.

Structurant/Thickeners i. Di-Benzylidene Polyol Acetal Derivative

The fluid detergent composition may comprise from about 0.01% to about 1% by weight of a dibenzylidene polyol acetal derivative (DBPA), or from about 0.05% to about 0.8%, or from about 0.1% to about 0.6%, or even from about 0.3% to about 0.5%. The DBPA derivative may comprise a dibenzylidene sorbitol acetal derivative (DBS). Said DBS derivative may be selected from the group consisting of: 1,3:2,4-dibenzylidene sorbitol; 1,3:2,4-di(p-methylbenzylidene) sorbitol; 1,3:2,4-di(p-chlorobenzylidene) sorbitol; 1,3:2,4-di (2,4-dimethyldibenzylidene) sorbitol; 1,3:2,4-di(p-ethylbenzylidene) sorbitol; and 1,3:2,4-di(3,4-dimethyldibenzylidene) sorbitol or mixtures thereof.

ii. Bacterial Cellulose

The fluid detergent composition may also comprise from about 0.005% to about 1% by weight of a bacterial cellulose network. The term "bacterial cellulose" encompasses any type of cellulose produced via fermentation of a bacteria of the genus *Acetobacter* such as CELLULON® by CPKelco U.S. and includes materials referred to popularly as microfibrillated cellulose, reticulated bacterial cellulose, and the like. In one aspect, said fibres have cross sectional dimensions of 1.6 nm to 3.2 nm by 5.8 nm to 133 nm Additionally, the bacterial cellulose fibres have an average microfibre length of at least about 100 nm, or from about 100 to about 1,500 nm In one aspect, the bacterial cellulose microfibres have an aspect ratio, meaning the average microfibre length divided by the widest cross sectional microfibre width, of from about 100:1 to about 400:1, or even from about 200:1 to about 300:1.

iii. Coated Bacterial Cellulose

In one aspect, the bacterial cellulose is at least partially coated with a polymeric thickener. In one aspect the at least partially coated bacterial cellulose comprises from about 0.1% to about 5%, or even from about 0.5% to about 3%, by weight of bacterial cellulose; and from about 10% to about 90% by weight of the polymeric thickener. Suitable bacterial cellulose may include the bacterial cellulose described above and suitable polymeric thickeners include: carboxymethylcellulose, cationic hydroxymethylcellulose, and mixtures thereof.

iv. Cellulose Fibers Non-Bacterial Cellulose Derived

In one aspect, the composition may further comprise from about 0.01 to about 5% by weight of the composition of a cellulosic fiber. Said cellulosic fiber may be extracted from vegetables, fruits or wood. Commercially available examples are Avicel® from FMC, Citri-Fi from Fiberstar or Betafib from Cosun.

v. Non-Polymeric Crystalline Hydroxyl-Functional Materials

In one aspect, the composition may further comprise from about 0.01 to about 1% by weight of the composition of a non-polymeric crystalline, hydroxyl functional structurant. Said non-polymeric crystalline, hydroxyl functional structurants generally may comprise a crystallizable glyceride which can be pre-emulsified to aid dispersion into the final fluid detergent composition. In one aspect, crystallizable glycerides may include hydrogenated castor oil or "HCO" or derivatives thereof, provided that it is capable of crystallizing in the liquid detergent composition.

vi. Polymeric Structuring Agents

Fluid detergent compositions of the present invention may comprise from about 0.01% to about 5% by weight of a naturally derived and/or synthetic polymeric structurant. Examples of naturally derived polymeric structurants of use in the present invention include: hydroxyethyl cellulose, hydrophobically modified hydroxyethyl cellulose, carboxymethyl cellulose, polysaccharide derivatives and mixtures thereof. Suitable polysaccharide derivatives include: pectine, alginate, arabinogalactan (gum Arabic), carrageenan, gellan gum, xanthan gum, guar gum and mixtures thereof. Examples of synthetic polymeric structurants of use in the present invention include: polycarboxylates, polyacrylates, hydrophobically modified ethoxylated urethanes, hydrophobically modified non-ionic polyols and mixtures thereof. In one aspect, said polycarboxylate polymer is a polyacrylate, polymethacrylate or mixtures thereof. In another aspect, the polyacrylate is a copolymer of unsaturated mono- or di-carbonic acid and $C_1$-$C_{30}$ alkyl ester of the (meth) acrylic acid. Said copolymers are available from Noveon inc under the tradename Carbopol Aqua 30.

vii. Di-Amido-Gellants

In one aspect, the external structuring system may comprise a di-amido gellant having a molecular weight from about 150 g/mol to about 1,500 g/mol, or even from about 500 g/mol to about 900 g/mol. Such di-amido gellants may comprise at least two nitrogen atoms, wherein at least two of said nitrogen atoms form amido functional substitution groups. In one aspect, the amido groups are different. In another aspect, the amido functional groups are the same. The di-amido gellant has the following formula:

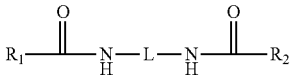

wherein:

$R_1$ and $R_2$ is an amino functional end-group, or even amido functional end-group, in one aspect $R_1$ and $R_2$ may comprise a pH-tuneable group, wherein the pH tuneable amido-gellant may have a pKa of from about 1 to about 30, or even from about 2 to about 10. In one aspect, the pH tuneable group may comprise a pyridine. In one aspect, $R_1$ and $R_2$ may be different. In another aspect, may be the same.

L is a linking moeity of molecular weight from 14 to 500 g/mol. In one aspect, L may comprise a carbon chain comprising between 2 and 20 carbon atoms. In another aspect, L may comprise a pH-tuneable group. In one aspect, the pH tuneable group is a secondary amine.

In one aspect, at least one of $R_1$, $R_2$ or L may comprise a pH-tuneable group.

Non-limiting examples of di-amido gellants are:

N,N-(2S,2'S)- 1,1'-(dodecane-1,12-diylbis(azanediyl))bis(3-methyl-1-oxobutane-2,1-diyl)diisonicotinamide

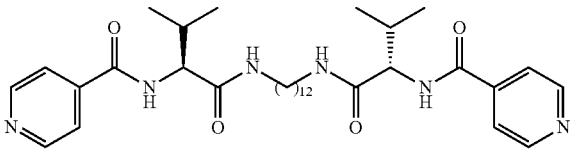

dibenzyl (2S,2'S)-1,1'-(propane-1,3-diylbis(azanediyl))bis(3-methyl-1-oxobutane-2,1-diyl)dicarbamate

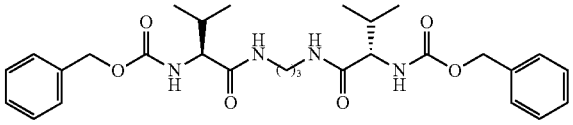

dibenzyl (2S,2'S)-1,1'-(dodecane-1,12-diylbis(azanediyl))bis(1-oxo-3-phenylpropane-2,1-diyl)dicarbamate

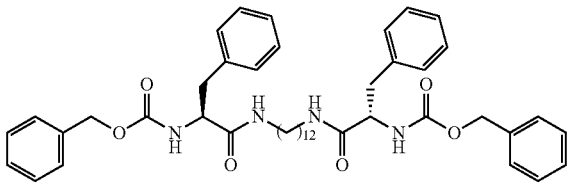

Polymeric Dispersing Agents

The detergent composition may comprise one or more polymeric dispersing agents. Examples are carboxymethylcellulose, poly(vinyl-pyrrolidone), poly (ethylene glycol), poly(vinyl alcohol), poly(vinylpyridine-N-oxide), poly(vinylimidazole), polycarboxylates such as polyacrylates, maleic/acrylic acid copolymers and lauryl methacrylate/acrylic acid co-polymers.

The detergent composition may comprise one or more amphiphilic cleaning polymers such as the compound having the following general structure: bis(($C_2H_5O$)($C_2H_4O$)n)($CH_3$)—$N^+$—$C_xH_{2x}$—$N^+$—($CH_3$)-bis(($C_2H_5O$)($C_2H_4O$)n), wherein n=from 20 to 30, and x=from 3 to 8, or sulphated or sulphonated variants thereof.

The detergent composition may comprise amphiphilic alkoxylated grease cleaning polymers which have balanced hydrophilic and hydrophobic properties such that they remove grease particles from fabrics and surfaces. The amphiphilic alkoxylated grease cleaning polymers may comprise a core structure and a plurality of alkoxylate groups attached to that core structure. These may comprise alkoxylated polyalkylenimines, for example, having an inner polyethylene oxide block and an outer polypropylene oxide block. Such compounds may include, but are not limited to, ethoxylated polyethyleneimine, ethoxylated hexamethylene diamine, and sulfated versions thereof. Polypropoxylated derivatives may also be included. A wide variety of amines and polyalklyeneimines can be alkoxylated to various degrees. A useful example is 600 g/mol polyethyleneimine core ethoxylated to 20 EO groups per NH and is available from BASF. The detergent compositions described herein may comprise from about 0.1% to about 10%, and in some examples, from about 0.1% to about 8%, and in other examples, from about 0.1% to about 6%, by weight of the detergent composition, of alkoxylated polyamines.

Carboxylate polymer—The detergent composition of the present invention may also include one or more carboxylate polymers, which may optionally be sulfonated. Suitable carboxylate polymers include a maleate/acrylate random copolymer or a poly(meth)acrylate homopolymer. In one aspect, the carboxylate polymer is a poly(meth)acrylate homopolymer having a molecular weight from 4,000 Da to 9,000 Da, or from 6,000 Da to 9,000 Da.

Alkoxylated polycarboxylates may also be used in the detergent compositions herein to provide grease removal. Such materials are described in WO 91/08281 and PCT 90/01815. Chemically, these materials comprise poly(meth) acrylates having one ethoxy side-chain per every 7-8 (meth) acrylate units. The side-chains are of the formula $—(CH_2CH_2O)_m (CH_2)_nCH_3$ wherein m is 2-3 and n is 6-12. The side-chains are ester-linked to the polyacrylate "backbone" to provide a "comb" polymer type structure. The molecular weight can vary, but may be in the range of about 2000 to about 50,000. The detergent compositions described herein may comprise from about 0.1% to about 10%, and in some examples, from about 0.25% to about 5%, and in other examples, from about 0.3% to about 2%, by weight of the detergent composition, of alkoxylated polycarboxylates.

The detergent compositions may include an amphiphilic graft co-polymer. A suitable amphiphilic graft co-polymer comprises (i) a polyethyelene glycol backbone; and (ii) and at least one pendant moiety selected from polyvinyl acetate, polyvinyl alcohol and mixtures thereof. A suitable amphilic graft co-polymer is Sokalan® HP22, supplied from BASF. Suitable polymers include random graft copolymers, preferably a polyvinyl acetate grafted polyethylene oxide copolymer having a polyethylene oxide backbone and multiple polyvinyl acetate side chains. The molecular weight of the polyethylene oxide backbone is typically about 6000 and the weight ratio of the polyethylene oxide to polyvinyl acetate is about 40 to 60 and no more than 1 grafting point per 50 ethylene oxide units.

Soil Release Polymer

The detergent compositions of the present invention may also include one or more soil release polymers having a structure as defined by one of the following structures (I), (II) or (III):

$$—[(OCHR^1—CHR^2)_a—O—OC—Ar—CO—]_d \quad (I)$$

$$—[(OCHR^3—CHR^4)_b—O—OC\text{-}sAr—CO—]_e \quad (II)$$

$$—[(OCHR^5—CHR^6)_c\text{-}OR^7]_f \quad (III)$$

wherein:

a, b and c are from 1 to 200;

d, e and f are from 1 to 50;

Ar is a 1,4-substituted phenylene;

sAr is 1,3-substituted phenylene substituted in position 5 with $SO_3Me$;

Me is Li, K, Mg/2, Ca/2, Al/3, ammonium, mono-, di-, tri-, or tetraalkylammonium wherein the alkyl groups are $C_1$-$C_{18}$ alkyl or $C_2$-$C_{10}$ hydroxyalkyl, or mixtures thereof;

$R^1$, $R^2$, $R^3$, $R^4$, $R^5$ and $R^6$ are independently selected from H or $C_1$-$C_{18}$ n- or iso-alkyl; and $R^7$ is a linear or branched $C_1$-$C_{18}$ alkyl, or a linear or branched $C_2$-$C_{30}$ alkenyl, or a cycloalkyl group with 5 to 9 carbon atoms, or a $C_8$-$C_{30}$ aryl group, or a $C_6$-$C_{30}$ arylalkyl group.

Suitable soil release polymers are polyester soil release polymers such as Repel-o-tex polymers, including Repel-o-tex SF, SF-2 and SRP6 supplied by Rhodia. Other suitable soil release polymers include Texcare polymers, including Texcare SRA100, SRA300, SRN100, SRN170, SRN240, SRN300 and SRN325 supplied by Clariant. Other suitable soil release polymers are Marloquest polymers, such as Marloquest SL supplied by Sasol.

Cellulosic Polymer

The cleaning compositions of the present invention may also include one or more cellulosic polymers including those selected from alkyl cellulose, alkyl alkoxyalkyl cellulose, carboxyalkyl cellulose, alkyl carboxyalkyl cellulose. In one aspect, the cellulosic polymers are selected from the group comprising carboxymethyl cellulose, methyl cellulose, methyl hydroxyethyl cellulose, methyl carboxymethyl cellulose, and mixures thereof. In one aspect, the carboxymethyl cellulose has a degree of carboxymethyl substitution from 0.5 to 0.9 and a molecular weight from 100,000 Da to 300,000 Da.

Examples of polymeric dispersing agents are found in U.S. Pat. No. 3,308,067, European Patent Application No. 66915, EP 193,360, and EP 193,360.

Additional Amines

Additional amines may be used in the cleaning compositions described herein for added removal of grease and particulates from soiled materials. The detergent compositions described herein may comprise from about 0.1% to about 10%, in some examples, from about 0.1% to about 4%, and in other examples, from about 0.1% to about 2%, by weight of the detergent composition, of additional amines. Non-limiting examples of additional amines may include, but are not limited to, polyetheramines, polyamines, oligoamines, triamines, diamines, pentamines, tetraamines, or combinations thereof. Specific examples of suitable additional amines include tetraethylenepentamine, triethylenetetraamine, diethylenetriamine, or a mixture thereof.

Bleaching Agents—The detergent compositions of the present invention may comprise one or more bleaching agents. Suitable bleaching agents other than bleaching catalysts include photobleaches, bleach activators, hydrogen peroxide, sources of hydrogen peroxide, pre-formed peracids and mixtures thereof. In general, when a bleaching agent is used, the detergent compositions of the present invention may comprise from about 0.1% to about 50% or even from about 0.1% to about 25% bleaching agent by weight of the detergent composition. Examples of suitable bleaching agents include: photobleaches; preformed peracids; sources of hydrogen peroxide; bleach activators having R—(C═O)-L wherein R is an alkyl group, optionally branched, having, when the bleach activator is hydrophobic, from 6 to 14 carbon atoms, or from 8 to 12 carbon atoms and, when the bleach activator is hydrophilic, less than 6 carbon atoms or even less than 4 carbon atoms; and L is leaving group. Suitable bleach activators include dodecanoyl oxybenzene sulphonate, decanoyl oxybenzene sulphonate, decanoyl oxybenzoic acid or salts thereof, 3,5,5-trimethyl hexanoyloxybenzene sulphonate, tetraacetyl ethylene diamine (TAED) and nonanoyloxybenzene sulphonate (NOBS).

Bleach Catalysts

The detergent compositions of the present invention may also include one or more bleach catalysts capable of accepting an oxygen atom from a peroxyacid and/or salt thereof, and transferring the oxygen atom to an oxidizeable substrate. Suitable bleach catalysts include, but are not limited to iminium cations and polyions; iminium zwitterions; modified amines; modified amine oxides; N-sulphonyl imines; N-phosphonyl imines; N-acyl imines; thiadiazole dioxides; perfluoroimines; cyclic sugar ketones and mixtures thereof.

Brighteners

Optical brighteners or other brightening or whitening agents may be incorporated at levels of from about 0.01% to about 1.2%, by weight of the composition, into the detergent compositions described herein. Commercial fluorescent brighteners suitable for the present invention can be classified into subgroups, including but not limited to: derivatives of stilbene, pyrazoline, coumarin, benzoxazoles, carboxylic acid, methinecyanines, dibenzothiophene-5,5-dioxide, azoles, 5- and 6-membered-ring heterocycles, and other miscellaneous agents. Examples of such brighteners are disclosed in "The Production and Application of Fluorescent Brightening Agents", M. Zahradnik, Published by John Wiley & Sons, New York (1982). Specific nonlimiting examples of optical brighteners which are useful in the present compositions are those identified in U.S. Pat. No. 4,790,856,U.S. Pat. No. 3,646,015U.S. Pat. No. 7,863,236 and its CN equivalent No. 1764714.

In some examples, the fluorescent brightener herein comprises a compound of formula (1):

(1)

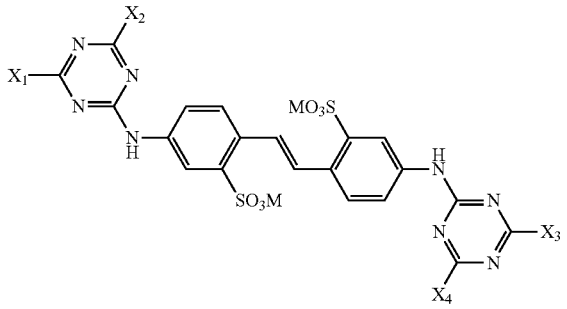

wherein: $X_1$, $X_2$, $X_3$, and $X_4$ are —N($R^1$)$R^2$, wherein $R^1$ and $R^2$ are independently selected from a hydrogen, a phenyl, hydroxyethyl, or an unsubstituted or substituted $C_1$-$C_8$ alkyl, or —N($R^1$)$R^2$ form a heterocyclic ring, preferably $R^1$ and $R^2$ are independently selected from a hydrogen or phenyl, or —N($R^1$)$R^2$ form a unsubstituted or substituted morpholine ring; and M is a hydrogen or a cation, preferably M is sodium or potassium, more preferably M is sodium.

In some examples, the fluorescent brightener is selected from the group consisting of disodium 4,4'-bis{[4-anilino-6-morpholino-s-triazin-2-yl]-amino}-2,2'-stilbenedisulfonate (brightener 15, commercially available under the tradename Tinopal AMS-GX by Ciba Geigy Corporation), disodium4, 4'-bis{[4-anilino-6-(N-2-bis-hydroxyethyl)-s-triazine-2-yl]-amino}-2,2'-stilbenedisulonate (commercially available under the tradename Tinopal UNPA-GX by Ciba-Geigy Corporation), disodium 4,4'-bis{[4-anilino-6-(N-2-hydroxyethyl-N-methylamino)-s-triazine-2-yl]-amino}-2,2'-stilbenedisulfonate (commercially available under the tradename Tinopal 5BM-GX by Ciba-Geigy Corporation). More preferably, the fluorescent brightener is disodium 4,4'-bis {[4-anilino-6-morpholino-s-triazin-2-yl]-amino}-2,2'-stilbenedisulfonate. The brighteners may be added in particulate form or as a premix with a suitable solvent, for example nonionic surfactant, monoethanolamine, propane diol.

Fabric Hueing Agents

The composition may comprise a fabric hueing agent (sometimes referred to as shading, bluing or whitening agents). Typically the hueing agent provides a blue or violet shade to fabric. Hueing agents can be used either alone or in combination to create a specific shade of hueing and/or to shade different fabric types. This may be provided for example by mixing a red and green-blue dye to yield a blue or violet shade. Hueing agents may be selected from any known chemical class of dye, including but not limited to acridine, anthraquinone (including polycyclic quinones), azine, azo (e.g., monoazo, disazo, trisazo, tetrakisazo, polyazo), including premetallized azo, benzodifurane and benzodifuranone, carotenoid, coumarin, cyanine, diazahemicyanine, diphenylmethane, formazan, hemicyanine, indigoids, methane, naphthalimides, naphthoquinone, nitro and nitroso, oxazine, phthalocyanine, pyrazoles, stilbene, styryl, triarylmethane, triphenylmethane, xanthenes and mixtures thereof.

Suitable fabric hueing agents include dyes, dye-clay conjugates, and organic and inorganic pigments. Suitable dyes include small molecule dyes and polymeric dyes. Suitable small molecule dyes include small molecule dyes selected from the group consisting of dyes falling into the Colour Index (C.I.) classifications of Direct, Basic, Reactive or hydrolysed Reactive, Solvent or Disperse dyes for example that are classified as Blue, Violet, Red, Green or Black, and provide the desired shade either alone or in combination. In another aspect, suitable small molecule dyes include small molecule dyes selected from the group consisting of Colour Index (Society of Dyers and Colourists, Bradford, UK) numbers Direct Violet dyes such as 9, 35, 48, 51, 66, and 99, Direct Blue dyes such as 1, 71, 80 and 279, Acid Red dyes such as 17, 73, 52, 88 and 150, Acid Violet dyes such as 15, 17, 24, 43, 49 and 50, Acid Blue dyes such as 15, 17, 25, 29, 40, 45, 75, 80, 83, 90 and 113, Acid Black dyes such as 1, Basic Violet dyes such as 1, 3, 4, 10 and 35, Basic Blue dyes such as 3, 16, 22, 47, 66, 75 and 159, Disperse or Solvent dyes such as those described in EP1794275 or EP1794276, or dyes as disclosed in U.S. Pat. No. 7,208,459B2, and mixtures thereof. In another aspect, suitable small molecule dyes include small molecule dyes selected from the group consisting of C. I. numbers Acid Violet 17, Direct Blue 71, Direct Violet 51, Direct Blue 1, Acid Red 88, Acid Red 150, Acid Blue 29, Acid Blue 113 or mixtures thereof.

Suitable polymeric dyes include polymeric dyes selected from the group consisting of polymers containing covalently bound (sometimes referred to as conjugated) chromogens, (dye-polymer conjugates), for example polymers with chromogens co-polymerized into the backbone of the polymer and mixtures thereof. Polymeric dyes include those described in WO2011/98355, WO2011/47987, US2012/090102, WO2010/145887, WO2006/055787 and WO2010/142503. In another aspect, suitable polymeric dyes include polymeric dyes selected from the group consisting of fabric-substantive colorants sold under the name of Liquitint® (Milliken, Spartanburg, S.C., USA), dye-polymer conjugates formed from at least one reactive dye and a polymer selected from the group consisting of polymers comprising a moiety selected from the group consisting of a hydroxyl moiety, a primary amine moiety, a secondary amine moiety, a thiol moiety and mixtures thereof. In still another aspect, suitable polymeric dyes include polymeric dyes selected from the group consisting of Liquitint® Violet CT, carboxymethyl cellulose (CMC) covalently bound to a reactive blue, reactive violet or reactive red dye such as CMC conjugated with C.I. Reactive Blue 19, sold by Megazyme, Wicklow, Ireland under the product name AZO-CM-CELLULOSE, product code S-ACMC, alkoxylated triphenyl-methane polymeric colourants, alkoxylated thiophene polymeric colourants, and mixtures thereof.

Preferred hueing dyes include the whitening agents found in WO 08/87497 A1, WO2011/011799 and WO2012/054835. Preferred hueing agents for use in the present invention may be the preferred dyes disclosed in these references, including those selected from Examples 1-42 in Table 5 of WO2011/011799. Other preferred dyes are disclosed in U.S. Pat. No. 8,138,222. Other preferred dyes are disclosed in WO2009/069077.

Suitable dye clay conjugates include dye clay conjugates selected from the group comprising at least one cationic/basic dye and a smectite clay, and mixtures thereof. In another aspect, suitable dye clay conjugates include dye clay conjugates selected from the group consisting of one cationic/basic dye selected from the group consisting of C.I. Basic Yellow 1 through 108, C.I. Basic Orange 1 through 69, C.I. Basic Red 1 through 118, C.I. Basic Violet 1 through 51, C.I. Basic Blue 1 through 164, C.I. Basic Green 1 through 14, C.I. Basic Brown 1 through 23, CI Basic Black 1 through 11, and a clay selected from the group consisting of Montmorillonite clay, Hectorite clay, Saponite clay and mixtures thereof. In still another aspect, suitable dye clay conjugates include dye clay conjugates selected from the group consisting of: Montmorillonite Basic Blue B7 C.I. 42595 conjugate, Montmorillonite Basic Blue B9 C.I. 52015 conjugate, Montmorillonite Basic Violet V3 C.I. 42555 conjugate, Montmorillonite Basic Green G1 C.I. 42040 conjugate, Montmorillonite Basic Red R1 C.I. 45160 conjugate, Montmorillonite C.I. Basic Black 2 conjugate, Hectorite Basic Blue B7 C.I. 42595 conjugate, Hectorite Basic Blue B9 C.I. 52015 conjugate, Hectorite Basic Violet V3 C.I. 42555 conjugate, Hectorite Basic Green G1 C.I. 42040 conjugate, Hectorite Basic Red R1 C.I. 45160 conjugate, Hectorite C.I. Basic Black 2 conjugate, Saponite Basic Blue B7 C.I. 42595 conjugate, Saponite Basic Blue B9 C.I. 52015 conjugate, Saponite Basic Violet V3 C.I. 42555 conjugate, Saponite Basic Green G1 C.I. 42040 conjugate, Saponite Basic Red R1 C.I. 45160 conjugate, Saponite C.I. Basic Black 2 conjugate and mixtures thereof.

Suitable pigments include pigments selected from the group consisting of flavanthrone, indanthrone, chlorinated indanthrone containing from 1 to 4 chlorine atoms, pyranthrone, dichloropyranthrone, monobromodichloropyranthrone, dibromodichloropyranthrone, tetrabromopyranthrone, perylene-3,4,9,10-tetracarboxylic acid diimide, wherein the imide groups may be unsubstituted or substituted by C1-C3-alkyl or a phenyl or heterocyclic radical, and wherein the phenyl and heterocyclic radicals may additionally carry substituents which do not confer solubility in water, anthrapyrimidinecarboxylic acid amides, violanthrone, isoviolanthrone, dioxazine pigments, copper phthalocyanine which may contain up to 2 chlorine atoms per molecule, polychloro-copper phthalocyanine or polybromochloro-copper phthalocyanine containing up to 14 bromine atoms per molecule and mixtures thereof.

In another aspect, suitable pigments include pigments selected from the group consisting of Ultramarine Blue (C.I. Pigment Blue 29), Ultramarine Violet (C.I. Pigment Violet 15) and mixtures thereof.

The aforementioned fabric hueing agents can be used in combination (any mixture of fabric hueing agents can be used).

Encapsulates

The compositions may comprise an encapsulate. The encapsulate may comprise a core, a shell having an inner and outer surface, where the shell encapsulates the core.

The encapsulate may comprise a core and a shell, where the core comprises a material selected from perfumes; brighteners; dyes; insect repellants; silicones; waxes; flavors; vitamins; fabric softening agents; skin care agents, e.g., paraffins; enzymes; anti-bacterial agents; bleaches; sensates; or mixtures thereof; and where the shell comprises a material selected from polyethylenes; polyamides; polyvinylalcohols, optionally containing other co-monomers; polystyrenes; polyisoprenes; polycarbonates; polyesters; polyacrylates; polyolefins; polysaccharides, e.g., alginate and/or chitosan; gelatin; shellac; epoxy resins; vinyl polymers; water insoluble inorganics; silicone; aminoplasts, or mixtures thereof. When the shell comprises an aminoplast, the aminoplast may comprise polyurea, polyurethane, and/or polyureaurethane. The polyurea may comprise polyoxymethyleneurea and/or melamine formaldehyde.

The encapsulate may comprise a core, and the core may comprise a perfume. The encapsulate may comprise a shell, and the shell may comprise melamine formaldehyde and/or cross linked melamine formaldehyde. The encapsulate may comprise a core comprising a perfume and a shell comprising melamine formaldehyde and/or cross linked melamine formaldehyde Suitable encapsulates may comprise a core material and a shell, where the shell at least partially surrounds the core material. At least 75%, or at least 85%, or even at least 90% of the encapsulates may have a fracture strength of from about 0.2 MPa to about 10 MPa, from about 0.4 MPa to about 5 MPa, from about 0.6 MPa to about 3.5 MPa, or even from about 0.7 MPa to about 3 MPa; and a benefit agent leakage of from 0% to about 30%, from 0% to about 20%, or even from 0% to about 5%.

At least 75%, 85% or even 90% of said encapsulates may have a particle size of from about 1 microns to about 80 microns, about 5 microns to 60 microns, from about 10 microns to about 50 microns, or even from about 15 microns to about 40 microns.

At least 75%, 85% or even 90% of said encapsulates may have a particle wall thickness of from about 30 nm to about 250 nm, from about 80 nm to about 180 nm, or even from about 100 nm to about 160 nm.

The core of the encapsulate comprises a material selected from a perfume raw material and/or optionally a material selected from vegetable oil, including neat and/or blended vegetable oils including caster oil, coconut oil, cottonseed oil, grape oil, rapeseed, soybean oil, corn oil, palm oil, linseed oil, safflower oil, olive oil, peanut oil, coconut oil, palm kernel oil, castor oil, lemon oil and mixtures thereof; esters of vegetable oils, esters, including dibutyl adipate, dibutyl phthalate, butyl benzyl adipate, benzyl octyl adipate, tricresyl phosphate, trioctyl phosphate and mixtures thereof; straight or branched chain hydrocarbons, including those straight or branched chain hydrocarbons having a boiling point of greater than about 80° C.; partially hydrogenated terphenyls, dialkyl phthalates, alkyl biphenyls, including monoisopropylbiphenyl, alkylated naphthalene, including dipropylnaphthalene, petroleum spirits, including kerosene, mineral oil or mixtures thereof; aromatic solvents, including benzene, toluene or mixtures thereof; silicone oils; or mixtures thereof.

The wall of the encapsulate may comprise a suitable resin, such as the reaction product of an aldehyde and an amine. Suitable aldehydes include formaldehyde. Suitable amines include melamine, urea, benzoguanamine, glycoluril, or mixtures thereof. Suitable melamines include methylol melamine, methylated methylol melamine, imino melamine and mixtures thereof. Suitable ureas include, dimethylol urea, methylated dimethylol urea, urea-resorcinol, or mixtures thereof.

Suitable formaldehyde scavengers may be employed with the encapsulates, for example, in a capsule slurry and/or added to a composition before, during, or after the encapsulates are added to such composition.

Suitable capsules can be purchased from Appleton Papers Inc. of Appleton, Wis. USA.

In addition, the materials for making the aforementioned encapsulates can be obtained from Solutia Inc. (St Louis, Mo. U.S.A.), Cytec Industries (West Paterson, N.J. U.S.A.), sigma-Aldrich (St. Louis, Mo. U.S.A.), CP Kelco Corp. of San Diego, Calif., USA; BASF AG of Ludwigshafen, Germany; Rhodia Corp. of Cranbury, N.J., USA; Hercules Corp. of Wilmington, Del., USA; Agrium Inc. of Calgary, Alberta, Canada, ISP of New Jersey U.S.A., Akzo Nobel of Chicago, Ill., USA; Stroever Shellac Bremen of Bremen, Germany;

Dow Chemical Company of Midland, Mich., USA; Bayer AG of Leverkusen, Germany; Sigma-Aldrich Corp., St. Louis, Mo., USA.

Perfumes

Perfumes and perfumery ingredients may be used in the detergent compositions described herein. Non-limiting examples of perfume and perfumery ingredients include, but are not limited to, aldehydes, ketones, esters, and the like. Other examples include various natural extracts and essences which can comprise complex mixtures of ingredients, such as orange oil, lemon oil, rose extract, lavender, musk, patchouli, balsamic essence, sandalwood oil, pine oil, cedar, and the like. Finished perfumes can comprise extremely complex mixtures of such ingredients. Finished perfumes may be included at a concentration ranging from about 0.01% to about 2% by weight of the detergent composition.

Dye Transfer Inhibiting Agents

Fabric detergent compositions may also include one or more materials effective for inhibiting the transfer of dyes from one fabric to another during the cleaning process. Generally, such dye transfer inhibiting agents may include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents may be used at a concentration of about 0.0001% to about 10%, by weight of the composition, in some examples, from about 0.01% to about 5%, by weight of the composition, and in other examples, from about 0.05% to about 2% by weight of the composition.

Chelating Agents

The detergent compositions described herein may also contain one or more metal ion chelating agents. Suitable molecules include copper, iron and/or manganese chelating agents and mixtures thereof. Such chelating agents can be selected from the group consisting of phosphonates, amino carboxylates, amino phosphonates, succinates, polyfunctionally-substituted aromatic chelating agents, 2-pyridinol-N-oxide compounds, hydroxamic acids, carboxymethyl inulins and mixtures thereof. Chelating agents can be present in the acid or salt form including alkali metal, ammonium, and substituted ammonium salts thereof, and mixtures thereof.

Other suitable chelating agents for use herein are the commercial DEQUEST series, and chelants from Monsanto, Akzo-Nobel, DuPont, Dow, the Trilon® series from BASF and Nalco.

The chelant may be present in the detergent compositions disclosed herein at from about 0.005% to about 15% by weight, about 0.01% to about 5% by weight, about 0.1% to about 3.0% by weight, or from about 0.2% to about 0.7% by weight, or from about 0.3% to about 0.6% by weight of the detergent compositions disclosed herein.

Suds Suppressors

Compounds for reducing or suppressing the formation of suds can be incorporated into the detergent compositions described herein. Suds suppression can be of particular importance in the so-called "high concentration cleaning process" as described in U.S. Pat. Nos. 4,489,455, 4,489,574, and in front-loading style washing machines.

A wide variety of materials may be used as suds suppressors, and suds suppressors are well known to those skilled in the art. See, for example, Kirk Othmer Encyclopedia of Chemical Technology, Third Edition, Volume 7, pages 430-447 (John Wiley & Sons, Inc., 1979). Examples of suds supressors include monocarboxylic fatty acid and soluble salts therein, high molecular weight hydrocarbons such as paraffin, fatty acid esters (e.g., fatty acid triglycerides), fatty acid esters of monovalent alcohols, aliphatic $C_{18}$-$C_{40}$ ketones (e.g., stearone), N-alkylated amino triazines, waxy hydrocarbons preferably having a melting point below about 100° C., silicone suds suppressors, and secondary alcohols.

Additional suitable antifoams are those derived from phenylpropylmethyl substituted polysiloxanes.

In certain examples, the detergent composition comprises a suds suppressor selected from organomodified silicone polymers with aryl or alkylaryl substituents combined with silicone resin and a primary filler, which is modified silica. The detergent compositions may comprise from about 0.001% to about 4.0%, by weight of the composition, of such a suds suppressor. In further examples, the detergent composition comprises a suds suppressor selected from: a) mixtures of from about 80 to about 92% ethylmethyl, methyl(2-phenylpropyl) siloxane; from about 5 to about 14% MQ resin in octyl stearate; and from about 3 to about 7% modified silica; b) mixtures of from about 78 to about 92% ethylmethyl, methyl(2-phenylpropyl) siloxane; from about 3 to about 10% MQ resin in octyl stearate; from about 4 to about 12% modified silica; or c) mixtures thereof, where the percentages are by weight of the anti-foam.

The detergent compositions herein may comprise from 0.1% to about 10%, by weight of the composition, of suds suppressor. When utilized as suds suppressors, monocarboxylic fatty acids, and salts thereof, may be present in amounts of up to about 5% by weight of the detergent composition, and in some examples, from about 0.5% to about 3% by weight of the detergent composition. Silicone suds suppressors may be utilized in amounts of up to about 2.0% by weight of the detergent composition, although higher amounts may be used. Monostearyl phosphate suds suppressors may be utilized in amounts ranging from about 0.1% to about 2% by weight of the detergent composition. Hydrocarbon suds suppressors may be utilized in amounts ranging from about 0.01% to about 5.0% by weight of the detergent composition, although higher levels can be used. Alcohol suds suppressors may be used at a concentration ranging from about 0.2% to about 3% by weight of the detergent composition.

Suds Boosters

If high sudsing is desired, suds boosters such as the $C_{10}$-$C_{16}$ alkanolamides may be incorporated into the detergent compositions at a concentration ranging from about 1% to about 10% by weight of the detergent composition. Some examples include the $C_{10}$-$C_{14}$ monoethanol and diethanol amides. If desired, water-soluble magnesium and/or calcium salts such as $MgCl_2$, $MgSO_4$, $CaCl_2$, $CaSO_4$, and the like, may be added at levels of about 0.1% to about 2% by weight of the detergent composition, to provide additional suds and to enhance grease removal performance.

Conditioning Agents

The composition of the present invention may include a high melting point fatty compound. The high melting point fatty compound useful herein has a melting point of 25° C. or higher, and is selected from the group consisting of fatty alcohols, fatty acids, fatty alcohol derivatives, fatty acid derivatives, and mixtures thereof. Such compounds of low melting point are not intended to be included in this section. Non-limiting examples of the high melting point compounds are found in International Cosmetic Ingredient Dictionary, Fifth Edition, 1993, and CTFA Cosmetic Ingredient Handbook, Second Edition, 1992.

The high melting point fatty compound is included in the composition at a level of from about 0.1% to about 40%, preferably from about 1% to about 30%, more preferably from about 1.5% to about 16% by weight of the composition, from about 1.5% to about 8%.

The composition of the present invention may include a nonionic polymer as a conditioning agent.

Suitable conditioning agents for use in the composition include those conditioning agents characterized generally as silicones (e.g., silicone oils, cationic silicones, silicone gums, high refractive silicones, and silicone resins), organic conditioning oils (e.g., hydrocarbon oils, polyolefins, and fatty esters) or combinations thereof, or those conditioning agents which otherwise form liquid, dispersed particles in the aqueous surfactant matrix herein. The concentration of the silicone conditioning agent typically ranges from about 0.01% to about 10%.

The compositions of the present invention may also comprise from about 0.05% to about 3% of at least one organic conditioning oil as the conditioning agent, either alone or in combination with other conditioning agents, such as the silicones (described herein). Suitable conditioning oils include hydrocarbon oils, polyolefins, and fatty esters.

Fabric Enhancement Polymers

Suitable fabric enhancement polymers are typically cationically charged and/or have a high molecular weight.

Suitable concentrations of this component are in the range from 0.01% to 50%, preferably from 0.1% to 15%, more preferably from 0.2% to 5.0%, and most preferably from 0.5% to 3.0% by weight of the composition. The fabric enhancement polymers may be a homopolymer or be formed from two or more types of monomers. The monomer weight of the polymer will generally be between 5,000 and 10,000,000, typically at least 10,000 and preferably in the range 100,000 to 2,000,000. Preferred fabric enhancement polymers will have cationic charge densities of at least 0.2 meq/gm, preferably at least 0.25 meq/gm, more preferably at least 0.3 meq/gm, but also preferably less than 5 meq/gm, more preferably less than 3 meq/gm, and most preferably less than 2 meq/gm at the pH of intended use of the composition, which pH will generally range from pH 3 to pH 9, preferably between pH 4 and pH 8.

The fabric enhancement polymers may be of natural or synthetic origin. Preferred fabric enhancement polymers may be selected from the group consisting of substituted and unsubstituted polyquaternary ammonium compounds, cationically modified polysaccharides, cationically modified (meth)acrylamide polymers/copolymers, cationically modified (meth)acrylate polymers/copolymers, chitosan, quaternized vinylimidazole polymers/copolymers, dimethyldiallylammonium polymers/copolymers, polyethylene imine based polymers, cationic guar gums, and derivatives thereof and combinations thereof.

Other fabric enhancement polymers suitable for the use in the compositions of the present invention include, for example: a) copolymers of 1-vinyl-2-pyrrolidine and 1-vinyl-3-methyl-imidazolium salt (e.g. chloride alt), referred to in the industry by the Cosmetic, Toiletry, and Fragrance Association, (CTFA) as Polyquaternium-16; b) copolymers of 1-vinyl-2-pyrrolidine and dimethylaminoethyl methacrylate, referred to in the industry (CTFA) as Polyquaternium-11; c) cationic diallyl quaternary ammonium-containing polymers including, for example, dimethyldiallylammonium chloride homopolymer and copolymers of acrylamide and dimethyldiallylammonium chloride, reffered to in the industry (CTFA) as Polyquaternium 6 and Polyquaternium 7, respectively; d) mineral acid salts of amino-alkyl esters of homo- and copolymers of unsaturated carboxylic acids having from 3 to 5 carbon atoms as describes in U.S. Pat. No. 4,009,256; e) amphoteric copolymers of acrylic acid including copolymers of acrylic acid and dimethyldiallylammonium chloride (referred to in the industry by CTFA as Polyquaternium 22), terpolymers of acrylic acid with dimethyldiallylammonium chloride and acrylamide (referred to in the industry by CTFA as Polyquaternium 39), and terpolymers of acrylic acid with methacrylamidopropyl trimethylammonium chloride and methylacrylate (referred to in the industry by CTFA as Polyquaternium 47).

Other fabric enhancement polymers suitable in the compositions of the present invention include cationic polysaccharide polymers, such as cationic cellulose and derivatives thereof, cationic starch and derivatives thereof, and cationic guar gums and derivatives thereof. Other suitable cationic polysaccharide polymers include quaternary nitrogen-containing cellulose ethers and copolymers of etherified cellulose and starch.

A particular suitable type of cationic polysaccharide polymer that can be used is a cationic guar gum derivative, such as the cationic polygalactomannan gum derivatives.

Pearlescent Agent

The laundry detergent compositions of the invention may comprise a pearlescent agent. Non-limiting examples of pearlescent agents include: mica; titanium dioxide coated mica; bismuth oxychloride; fish scales; mono and diesters of alkylene glycol of the formula:

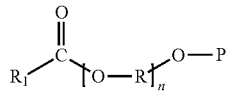

wherein:

a. $R_1$ is linear or branched C12-C22 alkyl group;

b. R is linear or branched C2-C4 alkylene group;

c. P is selected from H; C1-C4 alkyl; or —$COR_2$; and d. n=1-3.

The pearlescent agent may be ethyleneglycoldistearate (EGDS).

Hygiene and Malodour

The compositions of the present invention may also comprise one or more of zinc ricinoleate, thymol, quaternary ammonium salts such as Bardac®, polyethylenimines (such as Lupasol® from BASF) and zinc complexes thereof, silver and silver compounds, especially those designed to slowly release $Ag^+$ or nano-silver dispersions.

Fillers and Carriers

Fillers and carriers may be used in the detergent compositions described herein. As used herein, the terms "filler" and "carrier" have the same meaning and can be used interchangeably.

Liquid detergent compositions and other forms of detergent compositions that include a liquid component (such as liquid-containing unit dose detergent compositions) may contain water and other solvents as fillers or carriers. Suitable solvents also include lipophilic fluids, including siloxanes, other silicones, hydrocarbons, glycol ethers, glycerine derivatives such as glycerine ethers, perfluorinated amines, perfluorinated and hydrofluoroether solvents, low-volatility nonfluorinated organic solvents, diol solvents, and mixtures thereof.

Low molecular weight primary or secondary alcohols exemplified by methanol, ethanol, propanol, and isopropanol are suitable. Monohydric alcohols may be used in some examples for solubilizing surfactants, and polyols such as those containing from 2 to about 6 carbon atoms and from 2 to about 6 hydroxy groups (e.g., 1,3-propanediol, ethylene glycol, glycerine, and 1,2-propanediol) may also be used.

Amine-containing solvents, such as monoethanolamine, diethanolamine and triethanolamine, may also be used.

The detergent compositions may contain from about 5% to about 90%, and in some examples, from about 10% to about 50%, by weight of the composition, of such carriers. For compact or super-compact heavy duty liquid or other forms of detergent compositions, the use of water may be lower than about 40% by weight of the composition, or lower than about 20%, or lower than about 5%, or less than about 4% free water, or less than about 3% free water, or less than about 2% free water, or substantially free of free water (i.e., anhydrous).

For powder or bar detergent compositions, or forms that include a solid or powder component (such as powder-containing unit dose detergent composition), suitable fillers may include, but are not limited to, sodium sulfate, sodium chloride, clay, or other inert solid ingredients. Fillers may also include biomass or decolorized biomass. Fillers in granular, bar, or other solid detergent compositions may comprise less than about 80% by weight of the detergent composition, and in some examples, less than about 50% by weight of the detergent composition. Compact or supercompact powder or solid detergent compositions may comprise less than about 40% filler by weight of the detergent composition, or less than about 20%, or less than about 10%.

For either compacted or supercompacted liquid or powder detergent compositions, or other forms, the level of liquid or solid filler in the product may be reduced, such that either the same amount of active chemistry is delivered to the wash liquor as compared to noncompacted detergent compositions, or in some examples, the detergent composition is more efficient such that less active chemistry is delivered to the wash liquor as compared to noncompacted compositions. For example, the wash liquor may be formed by contacting the detergent composition to water in such an amount so that the concentration of detergent composition in the wash liquor is from above 0 g/1 to 6 g/l. In some examples, the concentration may be from about 0.5 g/1 to about 5 g/1, or to about 3.0 g/1, or to about 2.5 g/1, or to about 2.0 g/1, or to about 1.5 g/1, or from about 0 g/1 to about 1.0 g/1, or from about 0 g/1 to about 0.5 g/1. These dosages are not intended to be limiting, and other dosages may be used that will be apparent to those of ordinary skill in the art.

Buffer System

The detergent compositions described herein may be formulated such that, during use in aqueous cleaning operations, the wash water will have a pH of between about 7.0 and about 12, and in some examples, between about 7.0 and about 11. Techniques for controlling pH at recommended usage levels include the use of buffers, alkalis, or acids, and are well known to those skilled in the art. These include, but are not limited to, the use of sodium carbonate, citric acid or sodium citrate, lactic acid or lactate, monoethanol amine or other amines, boric acid or borates, and other pH-adjusting compounds well known in the art.

The detergent compositions herein may comprise dynamic in-wash pH profiles. Such detergent compositions may use wax-covered citric acid particles in conjunction with other pH control agents such that (i) about 3 minutes after contact with water, the pH of the wash liquor is greater than 10; (ii) about 10 minutes after contact with water, the pH of the wash liquor is less than 9.5; (iii) about 20 minutes after contact with water, the pH of the wash liquor is less than 9.0; and (iv) optionally, wherein, the equilibrium pH of the wash liquor is in the range of from about 7.0 to about 8.5.

Catalytic Metal Complexes

The detergent compositions may include catalytic metal complexes. One type of metal-containing bleach catalyst is a catalyst system comprising a transition metal cation of defined bleach catalytic activity, such as copper, iron, titanium, ruthenium, tungsten, molybdenum, or manganese cations, an auxiliary metal cation having little or no bleach catalytic activity, such as zinc or aluminum cations, and a sequestrate having defined stability constants for the catalytic and auxiliary metal cations, particularly ethylenediaminetetraacetic acid, ethylenediaminetetra(methylenephosphonic acid) and water-soluble salts thereof.

Water-Soluble Film

The compositions of the present invention may also be encapsulated within a water-soluble film. Preferred film materials are preferably polymeric materials. The film material can, for example, be obtained by casting, blow-moulding, extrusion or blown extrusion of the polymeric material, as known in the art.

Preferred polymers, copolymers or derivatives thereof suitable for use as pouch material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the pouch material, for example a PVA polymer, is at least 60%. The polymer can have any weight average molecular weight, preferably from about 1000 to 1,000,000, more preferably from about 10,000 to 300,000 yet more preferably from about 20,000 to 150,000. Mixtures of polymers can also be used as the pouch material.

Naturally, different film material and/or films of different thickness may be employed in making the compartments of the present invention. A benefit in selecting different films is that the resulting compartments may exhibit different solubility or release characteristics.

Suitable film materials are PVA films known under the MonoSol trade reference M8630, M8900, H8779 and PVA films of corresponding solubility and deformability characteristics. Further preferred films are those described in US2006/0213801, WO 2010/119022, US2011/0188784, and U.S. Pat. No. 6,787,512.

The film material herein can also comprise one or more additive ingredients. For example, it can be beneficial to add plasticisers, for example glycerol, ethylene glycol, diethyleneglycol, propylene glycol, sorbitol and mixtures thereof. Other additives include functional detergent additives to be delivered to the wash water, for example organic polymeric dispersants, etc.

The film is soluble or dispersible in water, and preferably has a water-solubility of at least 50%, preferably at least 75% or even at least 95%, as measured by the method set out here after using a glass-filter with a maximum pore size of 20 microns: 50 grams±0.1 gram of film material is added in a pre-weighed 400 ml beaker and 245 ml*1 ml of distilled water is added. This is stirred vigorously on a magnetic stirrer set at 600 rpm, for 30 minutes. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the percentage solubility or dispersability can be calculated.

The film may comprise an aversive agent, for example a bittering agent. Suitable bittering agents include, but are not limited to, naringin, sucrose octaacetate, quinine hydrochloride, denatonium benzoate, or mixtures thereof. Any suitable level of aversive agent may be used in the film. Suitable levels include, but are not limited to, 1 to 5000 ppm, or even 100 to 2500 ppm, or even 250 to 2000 rpm.

The film may comprise an area of print. The area of print may cover the entire film or part thereof. The area of print may comprise a single colour or maybe comprise multiple colours, even three colours. The area of print may comprise white, black and red colours. The area of print may comprise pigments, dyes, blueing agents or mixtures thereof. The print may be present as a layer on the surface of the film or may at least partially penetrate into the film.

Other Adjunct Ingredients

A wide variety of other ingredients may be used in the detergent compositions herein, including other active ingredients, carriers, hydrotropes, processing aids, dyes or pigments, solvents for liquid formulations, and solid or other liquid fillers, erythrosine, colliodal silica, waxes, probiotics, surfactin, aminocellulosic polymers, Zinc Ricinoleate, perfume microcapsules, rhamnolipids, sophorolipids, glycopeptides, methyl ester sulfonates, methyl ester ethoxylates, sulfonated estolides, cleavable surfactants, biopolymers, silicones, modified silicones, aminosilicones, deposition aids, locust bean gum, cationic hydroxyethylcellulose polymers, cationic guars, hydrotropes (especially cumenesulfonate salts, toluenesulfonate salts, xylenesulfonate salts, and naphalene salts), antioxidants, BHT, PVA particle-encapsulated dyes or perfumes, pearlescent agents, effervescent agents, color change systems, silicone polyurethanes, opacifiers, tablet disintegrants, biomass fillers, fast-dry silicones, glycol distearate, hydroxyethylcellulose polymers, hydrophobically modified cellulose polymers or hydroxyethylcellulose polymers, starch perfume encapsulates, emulsified oils, bisphenol antioxidants, microfibrous cellulose structurants, properfumes, styrene/acrylate polymers, triazines, soaps, superoxide dismutase, benzophenone protease inhibitors, functionalized TiO2, dibutyl phosphate, silica perfume capsules, and other adjunct ingredients, silicate salts (e.g., sodium silicate, potassium silicate), choline oxidase, pectate lyase, mica, titanium dioxide coated mica, bismuth oxychloride, and other actives.

The detergent compositions described herein may also contain vitamins and amino acids such as: water soluble vitamins and their derivatives, water soluble amino acids and their salts and/or derivatives, water insoluble amino acids viscosity modifiers, dyes, nonvolatile solvents or diluents (water soluble and insoluble), pearlescent aids, foam boosters, additional surfactants or nonionic cosurfactants, pediculocides, pH adjusting agents, perfumes, preservatives, chelants, proteins, skin active agents, sunscreens, UV absorbers, vitamins, niacinamide, caffeine, and minoxidil.

The detergent compositions of the present invention may also contain pigment materials such as nitroso, monoazo, disazo, carotenoid, triphenyl methane, triaryl methane, xanthene, quinoline, oxazine, azine, anthraquinone, indigoid, thionindigoid, quinacridone, phthalocianine, botanical, and natural colors, including water soluble components such as those having C.I. Names. The detergent compositions of the present invention may also contain antimicrobial agents.

Method of Making Cleaning Compositions

The cleaning compositions of the present disclosure may be prepared by conventional methods known to one skilled in the art, such as by a batch process or by a continuous loop process. The cleaning compositions of the present invention can be formulated into any suitable form and prepared by any process chosen by the formulator.

Method of Making a Unit Dose Article

The method of making a unit dose article or pouch may be continuous or intermittent. The method comprises the general steps of forming an open pouch, preferably by forming a water-soluble film into a mould to form said open pouch, filling the open pouch with a composition, closing the open pouch filled with a composition, preferably using a second water-soluble film to form the unit dose article. The second film may also comprise compartments, which may or may not comprise compositions. Alternatively, the second film may be a second closed pouch containing one or more compartments, used to close the open pouch. The process may be one in which a web of unit dose article are made, said web is then cut to form individual unit dose articles.

Alternatively, the first film may be formed into an open pouch comprising more than one compartment. In which case, the compartments formed from the first pouch may are in a side-by-side or 'tyre and rim' orientation. The second film may also comprise compartments, which may or may not comprise compositions. Alternatively, the second film may be a second closed pouch used to close the multicompartment open pouch.

The unit dose article may be made by thermoforming, vacuum-forming or a combination thereof. Unit dose articles may be sealed using any sealing method known in the art. Suitable sealing methods may include heat sealing, solvent sealing, pressure sealing, ultrasonic sealing, pressure sealing, laser sealing or a combination thereof.

The unit dose articles may be dusted with a dusting agent. Dusting agents can include talc, silica, zeolite, carbonate or mixtures thereof.

An exemplary means of making the unit dose article of the present invention is a continuous process for making an article according to any preceding claims, comprising the steps of:

a. continuously feeding a first water-soluble film onto a horizontal portion of an continuously and rotatably moving endless surface, which comprises a plurality of moulds, or onto a non-horizontal portion thereof and continuously moving the film to said horizontal portion;

b. forming from the film on the horizontal portion of the continuously moving surface, and in the moulds on the surface, a continuously moving, horizontally positioned web of open pouches;

c. filling the continuously moving, horizontally positioned web of open pouches with a product, to obtain a horizontally positioned web of open, filled pouches;

d. preferably continuously, closing the web of open pouches, to obtain closed pouches, preferably by feeding a second water-soluble film onto the horizontally positioned web of open, filed pouches, to obtain closed pouches; and e. optionally sealing the closed pouches to obtain a web of closed pouches.

The second water-soluble film may comprise at least one open or closed compartment. In one embodiment, a first web of open pouches is combined with a second web of closed pouches preferably wherein the first and second webs are brought together and sealed together via a suitable means, and preferably wherein the second web is a rotating drum set-up. In such a set-up, pouches are filled at the top of the drum and preferably sealed afterwards with a layer of film, the closed pouches come down to meet the first web of pouches, preferably open pouches, formed preferably on a horizontal forming surface. It has been found especially suitable to place the rotating drum unit above the horizontal forming surface unit.

Preferably, the resultant web of closed pouches are cut to produce individual unit dose articles.

The unit dose article may comprise an area of print. The area of print may be present on the outside of the unit dose article, or maybe on the inner surface of the film, i.e. in contact with the liquid laundry detergent composition. Alternatively, the area of print may be present ion both the outside and the inside of the unit dose article.

The unit dose article may comprise at least two films, or even at least three films, wherein the films are sealed together. The area of print may be present on one film, or on more than film, e.g. on two films, or even on three films.

The area of print may be achieved using standard techniques, such as flexographic printing or inkjet printing. Preferably, the area of print is achieved via flexographic printing, in which a film is printed, then moulded into a unit dose article via steps a-e above. Printing may be on the inside or the outside of the unit dose article.

Those skilled in the art would recognize the appropriate size of mould needed in order to make a unit dose article according to the present invention.

The unit dose article may comprise an aversive agent.

The unit dose article may rupture between 10 seconds and 5 minutes once the unit dose article has been added to 950 ml of deionised water at 20-21° C. in a 1 L beaker, wherein the water is stirred at 350 rpm with a 5 cm magnetic stirrer bar. By rupture, we herein mean the film is seen to visibly break or split. Shortly after the film breaks or splits the internal liquid detergent composition may be seen to exit the unit dose article into the surrounding water.

Methods of Use

The present invention includes methods for cleaning soiled material. As will be appreciated by one skilled in the art, the detergent compositions of the present invention are suited for use in laundry pretreatment applications, laundry cleaning applications, and home care applications.

Such methods include, but are not limited to, the steps of contacting detergent compositions in neat form or diluted in wash liquor, with at least a portion of a soiled material and then optionally rinsing the soiled material. The soiled material may be subjected to a washing step prior to the optional rinsing step.

For use in laundry pretreatment applications, the method may include contacting the detergent compositions described herein with soiled fabric. Following pretreatment, the soiled fabric may be laundered in a washing machine or otherwise rinsed.

Machine laundry methods may comprise treating soiled laundry with an aqueous wash solution in a washing machine having dissolved or dispensed therein an effective amount of a machine laundry detergent composition in accord with the invention. An "effective amount" of the detergent composition means from about 20 g to about 300 g of product dissolved or dispersed in a wash solution of volume from about 5 L to about 65 L. The water temperatures may range from about 5° C. to about 100° C. The water to soiled material (e.g., fabric) ratio may be from about 1:1 to about 30:1. The compositions may be employed at concentrations of from about 500 ppm to about 15,000 ppm in solution. In the context of a fabric laundry composition, usage levels may also vary depending not only on the type and severity of the soils and stains, but also on the wash water temperature, the volume of wash water, and the type of washing machine (e.g., top-loading, front-loading, top-loading, vertical-axis Japanese-type automatic washing machine).

The detergent compositions herein may be used for laundering of fabrics at reduced wash temperatures. These methods of laundering fabric comprise the steps of delivering a laundry detergent composition to water to form a wash liquor and adding a laundering fabric to said wash liquor, wherein the wash liquor has a temperature of from about 0° C. to about 20° C., or from about 0° C. to about 15° C., or from about 0° C. to about 9° C. The fabric may be contacted to the water prior to, or after, or simultaneous with, contacting the laundry detergent composition with water.

Another method includes contacting a nonwoven substrate, which is impregnated with the detergent composition, with a soiled material. As used herein, "nonwoven substrate" can comprise any conventionally fashioned nonwoven sheet or web having suitable basis weight, caliper (thickness), absorbency, and strength characteristics. Non-limiting examples of suitable commercially available nonwoven substrates include those marketed under the tradenames SONTARA® by DuPont and POLYWEB® by James River Corp.

Hand washing/soak methods, and combined handwashing with semi-automatic washing machines, are also included.

Machine Dishwashing Methods

Methods for machine-dishwashing or hand dishwashing soiled dishes, tableware, silverware, or other kitchenware, are included. One method for machine dishwashing comprises treating soiled dishes, tableware, silverware, or other kitchenware with an aqueous liquid having dissolved or dispensed therein an effective amount of a machine dishwashing composition in accord with the invention. By an effective amount of the machine dishwashing composition it is meant from about 8 g to about 60 g of product dissolved or dispersed in a wash solution of volume from about 3 L to about 10 L.

One method for hand dishwashing comprises dissolution of the detergent composition into a receptacle containing water, followed by contacting soiled dishes, tableware, silverware, or other kitchenware with the dishwashing liquor, then hand scrubbing, wiping, or rinsing the soiled dishes, tableware, silverware, or other kitchenware. Another method for hand dishwashing comprises direct application of the detergent composition onto soiled dishes, tableware, silverware, or other kitchenware, then hand scrubbing, wiping, or rinsing the soiled dishes, tableware, silverware, or other kitchenware. In some examples, an effective amount of detergent composition for hand dishwashing is from about 0.5 ml. to about 20 ml. diluted in water.

Packaging for the Compositions

The detergent compositions described herein can be packaged in any suitable container including those constructed from paper, cardboard, plastic materials, and any suitable laminates.

Multi-Compartment Pouch Additive

The detergent compositions described herein may also be packaged as a multi-compartment detergent composition.

EXAMPLES

In the following examples, the individual ingredients within the cleaning compositions are expressed as percentages by weight of the cleaning compositions unless indicated otherwise. Also, in the following examples, the following abbreviations are used:

BuO=butylene oxide

PO=propylene oxide

Example 1

1 Mol Pentaerythritol+4 Moles BuO+4 Moles PO, Aminated 1-a) 1 Mol Pentaerythritol+4 Moles BuO+4 Moles PO In a 2 1 autoclave 136.0 g pentaerythritol, 1.3 g potassium tert.-butylat and 200.0 ml xylene are mixed. The autoclave is purged three times with nitrogen and heated to 140° C. 288.0 g butylene oxide is added within 3 hours. The mixture is allowed to post-react for 14 hours at 140° C. Then, 232.0 g propylene oxide is added in portions within 2 hours. To complete the reaction, the mixture is allowed to post-react for additional 8 hours at 140° C. The reaction mixture is stripped with nitrogen and volatile compounds are removed in vacuo at 80° C. The catalyst is removed by adding 10.5 g Macrosorb MP5plus, stiffing at 100° C. for 2 hours and filtration. A yellowish oil is obtained (643.0 g, hydroxy value: 284 mgKOH/g).

1-b) 1 Mol Pentaerythritol+4 Moles BuO+4 Moles PO, Aminated

In a 300 mL autoclave 60 g of the resulting tetraol mixture from example 1-a and 60 g of ammonia are mixed in the presence of 15 g of a solid catalyst. The catalyst containing oxides of nickel, copper, cobalt and tin on aluminum oxide is in the form of 3×3 mm tablets. The autoclave is purged with hydrogen and pressurized to 20 bar before the mixture is heated to 215° C. The pressure is increased to 280 bar and the reaction mixture is stirred for 30 hours at 215° C. and the total pressure is maintained at 280 bar. After 30 hours the autoclave is cooled to ambient temperature, the product is collected, filtered, and stripped on a rotary evaporator to remove light amines and water to give a low-color polyetheramine. The analytical results thereof are shown in Table 1.

TABLE 1

| Total amine-value mg KOH/g | Total acetylatables (theory) mg KOH/g | Secondary and tertiary amine value mg KOH/g | Tertiary amine-value mg KOH/g | Hydroxyl value mg KOH/g | Grade of amination in % | Primary Amine in % of total amine |
|---|---|---|---|---|---|---|
| 329.87 | 342.00 | 4.49 | n.d. | 12.13 | 96.45 | 98.64 |

Example 2

Comparative Grease Stain Removal from Laundry Detergent Compositions

The following laundry detergent compositions are prepared by traditional means known to those of ordinary skill in the art by mixing the listed ingredients. Composition A is a conventional (nil-polyetheramine) laundry detergent. Liquid detergent composition B contains a polyetheramine as prepared by Example 1 (see, e.g., Formula A).

Formula A

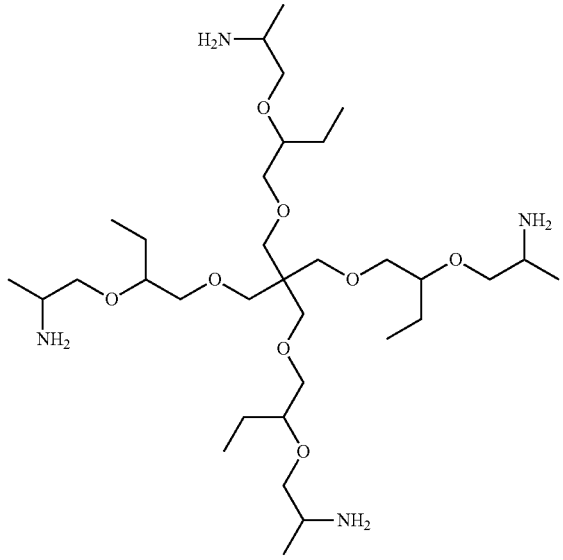

| | Liquid HDL A (wt %) | Liquid HDL B (wt %) |
|---|---|---|
| AE3S[4] | 2.6 | 2.6 |
| Alkyl benzene sulfonate[3] | 7.5 | 7.5 |
| Sodium formate/Calcium formate | 0.4 | 0.4 |
| Sodium hydroxide | 3.7 | 3.7 |
| Monoethanolamine (MEA) | 0.3 | 0.3 |
| Diethylene glycol (DEG) | 0.8 | 0.8 |
| AE9[6] | 0.4 | 0.4 |
| AE7[5] | 4.4 | 4.4 |
| Polyetheramine[11] | — | 2.0 |
| Chelant[7] | 0.3 | 0.3 |
| Citric Acid | 3.2 | 3.2 |
| $C_{12-18}$ Fatty Acid | 3.1 | 3.1 |
| Ethanol | 2.0 | 2.0 |
| Ethoxylated Polyethylenimine[1] | 1.5 | 1.5 |
| Amphiphilic polymer[2] | 0.5 | 0.5 |

-continued

| | Liquid HDL A (wt %) | Liquid HDL B (wt %) |
|---|---|---|
| A compound having the following general structure: bis($(C_2H_5O)(C_2H_4O)n)(CH_3)$-$N^+$- | 1.0 | 1.0 |

-continued

| | Liquid HDL A (wt %) | Liquid HDL B (wt %) |
|---|---|---|
| $C_xH_{2x}$-$N^+$-($CH_3$)-bis(($C_2H_5O$)($C_2H_4O$)n), wherein n = from 20 to 30, and x = from 3 to 8, or sulphated or sulphonated variants thereof | | |
| 1,2-Propanediol | 3.9 | 3.9 |
| Protease (40.6 mg active/g)[9] | 0.6 | 0.6 |
| Amylase: Stainzyme ® (15 mg active/g)[8] | 0.2 | 0.2 |
| Fluorescent Whitening Agents[10] | 0.1 | 0.1 |
| Water, perfume, dyes & other components | Balance | |

1. Polyethyleneimine (MW=600) with 20 ethoxylate groups per —NH.

2. Random graft copolymer is a polyvinyl acetate grafted polyethylene oxide copolymer having a polyethylene oxide backbone and multiple polyvinyl acetate side chains. The molecular weight of the polyethylene oxide backbone is about 6000 and the weight ratio of the polyethylene oxide to polyvinyl acetate is about 40 to 60 and no more than 1 grafting point per 50 ethylene oxide units.

3. Linear alkylbenzenesulfonate having an average aliphatic carbon chain length $C_{11}$-$C_{12}$ supplied by Stepan, Northfield, Ill., USA 4. AE3S is $C_{12-15}$ alkyl ethoxy (3) sulfate supplied by Stepan, Northfield, Ill., USA 5. AE7 is $C_{12-15}$ alcohol ethoxylate, with an average degree of ethoxylation of 7, supplied by Huntsman, Salt Lake City, Utah, USA 6. AE9 is $C_{12-13}$ alcohol ethoxylate, with an average degree of ethoxylation of 9, supplied by Huntsman, Salt Lake City, Utah, USA 7. Suitable chelants are, for example, diethylenetetraamine pentaacetic acid (DTPA) supplied by Dow Chemical, Midland, Mich., USA or Hydroxyethane di phosphonate (HEDP) supplied by Solutia, St Louis, Mo., USA Bagsvaerd, Denmark 8. Savinase®, Natalase®, Stainzyme®, Lipex®, Celluclean™, Mannaway® and Whitezyme® are all products of Novozymes, Bagsvaerd, Denmark.

9. Proteases may be supplied by Genencor International, Palo Alto, Calif., USA (e.g. Purafect Prime®) or by Novozymes, Bagsvaerd, Denmark (e.g. Liquanase®, Coronase®).

10. Suitable Fluorescent Whitening Agents are for example, Tinopal® AMS, Tinopal® CBS-X, Sulphonated zinc phthalocyanine Ciba Specialty Chemicals, Basel, Switzerland 11. Polyetheramine of Example 1.

Technical stain swatches of cotton CW120 containing bacon grease, beef fat, lard, burnt beef, burnt butter, makeup are purchased from from Warwick Equest Limited, Unit 55 Derwentside Business Centre, Consett, Co Durham, DH8 6BN. The stained swatches are washed in conventional western European washing machines (Meile®) using 14 grains per gallon hardness, selecting the cotton cycle at 30° C., using 80 g of each of the respective detergent compositions listed in the table above. Image analysis is used to compare each stain to an unstained fabric control. Software converts images taken into standard colorimetric values and compares these to standards based on the commonly used Macbeth Colour Rendition Chart, assigning each stain a colorimetric value (Stain Level). Eight replicates of each are prepared. The stain removal index is then calculated according to the formula shown below.

Stain removal from the swatches is measured as follows:

$$\text{Stain Removal Index } (SRI) = \frac{\Delta E_{initial} - E_{washed}}{\Delta E_{initial}} \times 100$$

$\Delta E_{initial}$ = Stain level before washing $\Delta E_{washed}$ = Stain level after washing

| | Liquid Composition A | Liquid Composition B | LSD |
|---|---|---|---|
| Bacon Grease | 49.5 | +5.0 | 4.6 |
| Beef Fat | 47.8 | +3.6 | 4.9 |
| Lard | 48.1 | +3.7 | 3.7 |
| Burnt Beef | 54.7 | +4.3 | 8.4 |
| Burnt Butter | 70.3 | +4.9 | 7.9 |
| Make up | 53.2 | +5.5 | 7.1 |

These results illustrate the surprising grease removal benefit of the polyetheramine of the invention (as used in Composition B), as compared to a conventional (nil-polyetheramine) liquid detergent (Composition A), especially on bacon grease and lard.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A cleaning composition comprising:

from about 1% to about 70%, by weight of the composition, of a surfactant which comprises one or more surfactants selected from the group consisting of anionic surfactants, cationic surfactants, nonionic surfactants, zwitterionic surfactants, and amphoteric surfactants; and-from about 0.1% to about 10%, by weight of the composition, of a polyetheramine of Formula (I):

Formula (I)

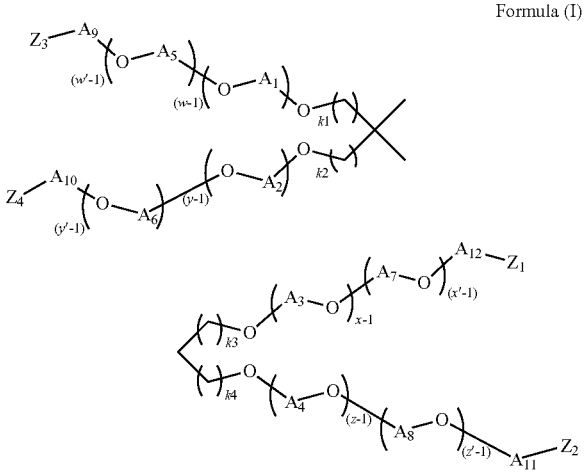

wherein each of $k_1$, $k_2$, $k_3$, and $k_4$ is independently selected from 0, 1, 2, 3, 4, 5, or 6, each of $A_1$, $A_2$, $A_3$, $A_4$, $A_{59}$ $A_6$, $A_7$, $A_8$, $A_9$, $A_{10}$, $A_{11}$, and $A_{12}$ is independently selected from a linear or branched alkylene group having from about 2 to about 18 carbon atoms or mixtures thereof, $x \geq 1$, $y \geq 1$, $w \geq 1$, and $z \geq 1$, and the sum of $x+y+w+z$ is in the range of from about 4 to about 100, $x' \geq 1$, $y' \geq 1$, $w' \geq 1$, and $z' \geq 1$, and the sum of $x'+y'+w'+z'$ is in the range of from about 4 to about 100, and each of $Z_1$, $Z_2$, $Z_3$, and $Z_4$ is independently selected from OH, $NH_2$, NHR', or NR'R", where R' and R" are independently selected from alkylenes having 2 to 6 carbon atoms, and wherein at least one of $Z_1$, $Z_2$, $Z_3$, and $Z_4$ is $NH_2$.

2. The cleaning composition of claim 1, wherein in said polyetheramine of Formula (I), each of $k_1$, $k_2$, $k_3$, and $k_4$ is independently selected from 0, 1, or 2.

3. The cleaning composition of claim 1, wherein each of $k_1$, $k_2$, $k_3$, and $k_4$ is 1.

4. The cleaning composition of claim 1, wherein in said polyetheramine of Formula (I), each of $A_1$, $A_2$, $A_3$, $A_4$, $A_5$, $A_6$, $A_7$, $A_8$, $A_9$, $A_{10}$, $A_{11}$, and $A_{12}$ is independently selected from a linear or branched alkylene group having from about 2 to about 10 carbon atoms.

5. The cleaning composition of claim 1, wherein in said polyetheramine of Formula (I), each of $A_1$, $A_2$, $A_3$, $A_4$, $A_5$, $A_6$, $A_7$, $A_8$, $A_9$, $A_{10}$, $A_{11}$, and $A_{12}$ is independently selected from a linear or branched alkylene group having from about 2 to about 4 carbon atoms.

6. The cleaning composition of claim 1, wherein in said polyetheramine of Formula (I), at least one of $A_1$, $A_2$, $A_3$, $A_4$, $A_5$, $A_6$, $A_7$, $A_8$, $A_9$, $A_{10}$, $A_{11}$, and $A_{12}$ is a linear or branched butylene group.

7. The cleaning composition of claim 1, wherein in said polyetheramine of Formula (I), the sum of $x+y+w+z$ is in the range of from about 4 to about 30.

8. The cleaning composition of claim 1, wherein in said polyetheramine of Formula (I), the sum of $x'+y'+w'+z'$ is in the range of from about 4 to about 30.

9. The cleaning composition of claim 1, wherein said polyetheramine of Formula (I) has a weight average molecular weight of from about 350 to about 1000 grams/mole.

10. The cleaning composition of claim 1, wherein said polyetheramine of Formula (I) has a weight average molecular weight of from about 400 to about 800 grams/mole.

11. The cleaning composition of claim 1, wherein said cleaning composition comprises from about 0.2% to about 5%, by weight of the composition, of the polyetheramine of Formula (I).

12. The cleaning composition of claim 1 further comprising from about 0.001% to about 1% by weight of an enzyme.

13. The cleaning composition of claim 12, wherein said enzyme is selected from the group consisting of lipase, amylase, protease, mannanase, and combinations thereof.

14. The cleaning composition of claim 1 further comprising from about 0.1% to about 10% by weight of an additional amine selected from polyetheramines, oligoamines, triamines, diamines, or a combination thereof.

15. A method of pretreating or treating a soiled fabric comprising contacting the soiled fabric with the cleaning composition of claim 1.

* * * * *